US009645538B2

(12) United States Patent
Watanabe et al.

(10) Patent No.: US 9,645,538 B2
(45) Date of Patent: May 9, 2017

(54) DEVELOPING DEVICE, AND IMAGE FORMING APPARATUS AND PROCESS CARTRIDGE INCORPORATING SAME

(71) Applicants: Masahiro Watanabe, Kanagawa (JP); Tetsuro Hirota, Kanagawa (JP)

(72) Inventors: Masahiro Watanabe, Kanagawa (JP); Tetsuro Hirota, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/177,620

(22) Filed: Jun. 9, 2016

(65) Prior Publication Data

US 2016/0378039 A1 Dec. 29, 2016

(30) Foreign Application Priority Data

Jun. 24, 2015 (JP) ..... 2015-127029

(51) Int. Cl.

| | |
|---|---|
| ***G03G 15/08*** | (2006.01) |
| ***G03G 15/00*** | (2006.01) |
| ***G03G 21/18*** | (2006.01) |
| ***G03G 21/16*** | (2006.01) |

(52) U.S. Cl.

CPC ..... *G03G 15/556* (2013.01); *G03G 21/1652* (2013.01); *G03G 21/1839* (2013.01)

(58) Field of Classification Search

CPC ..... G03G 15/556; G03G 21/1652; G03G 21/1839

USPC ..... 399/30

See application file for complete search history.

(56) References Cited

U.S. PATENT DOCUMENTS

| | | | | |
|---|---|---|---|---|
| 2012/0134701 | A1* | 5/2012 | Sue | G03G 15/0189 399/71 |
| 2014/0312886 | A1 | 10/2014 | Hirota et al. | |
| 2015/0268028 | A1 | 9/2015 | Hirota et al. | |
| 2016/0116860 | A1 | 4/2016 | Hirota et al. | |

FOREIGN PATENT DOCUMENTS

| | | |
|---|---|---|
| JP | 1-291274 | 11/1989 |
| JP | 1-314271 | 12/1989 |
| JP | 4-050880 | 2/1992 |
| JP | 8-271481 | 10/1996 |
| JP | 2000-047476 | 2/2000 |
| JP | 2002-268295 | 9/2002 |
| JP | 2008-203064 | 9/2008 |
| JP | 2014-224805 | 12/2014 |
| JP | 2014-235137 | 12/2014 |
| JP | 2014-235386 | 12/2014 |
| JP | 2015-001617 | 1/2015 |
| JP | 2015-014687 | 1/2015 |

OTHER PUBLICATIONS

U.S. Appl. No. 14/958,090, filed Dec. 3, 2015.

* cited by examiner

*Primary Examiner* — Susan Lee

(74) *Attorney, Agent, or Firm* — Oblon, McClelland, Maier & Neustadt, L.L.P.

(57) ABSTRACT

A developing device includes a developer bearer disposed opposite an image bearer and configured to rotate and carry developer to a latent image on the image bearer, a developer container to contain the developer, a detector including a detecting portion to detect a density of toner in the developer in the developer container, a wire connected to the detector, and a wire holder to hold the wire and determine a position of the wire relative to the detector.

11 Claims, 20 Drawing Sheets

DEVELOPING DEVICE, AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. §119(a) to Japanese Patent Application No. 2015-127029, filed on Jun. 24, 2015, in the Japan Patent Office, the entire disclosure of which is hereby incorporated by reference herein.

BACKGROUND

Technical Field

Embodiments of the present invention generally relate to a developing device, and a process cartridge and an image forming apparatus, such as a copier, a printer, a facsimile machine, or a multifunction peripheral having at least two of copying, printing, facsimile transmission, plotting, and scanning capabilities, that include the developing device.

Description of the Related Art

There are developing devices that use two-component developer including toner and magnetic carrier (hereinafter "two-component developing devices). Two-component developing devices typically include a developer bearer, such as a rotatable developing sleeve, a magnetic field generator, such as a magnet roller, disposed inside the image bearer, and a developer regulator disposed facing the image bearer. After the developer regulator adjusts the amount of developer on the developer bearer, the developer on the developer bearer is transported to a developing range facing a latent image bearer (e.g., a photoconductor), and the developer is used in image development. The toner in the developer contained in such developing devices is consumed in image development, and a toner density detector detects the percentage of toner in developer in the developing device. According to the detection result, toner is supplied to the developing device, thereby keeping the density of toner in developer therein within a predetermined range.

SUMMARY

An embodiment of the present invention provides a developing device that includes a developer bearer disposed opposite an image bearer and configured to rotate and carry developer to a latent image on the image bearer, a developer container to contain the developer, a detector including a detecting portion to detect a density of toner in the developer in the developer container, a wire connected to the detector, and a wire holder to hold the wire and determine a position of the wire relative to the detector.

In another embodiment, an image forming apparatus includes the image bearer, a latent image forming device to form an electrostatic latent image on the image bearer, and the above-described developing device to develop the electrostatic latent image.

Yet another embodiment concerns a process cartridge to be removably mounted in an image forming apparatus. The process cartridge includes the image bearer to bear an electrostatic latent image, the developing device described above, and a common support to support the developing device together with the image bearer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
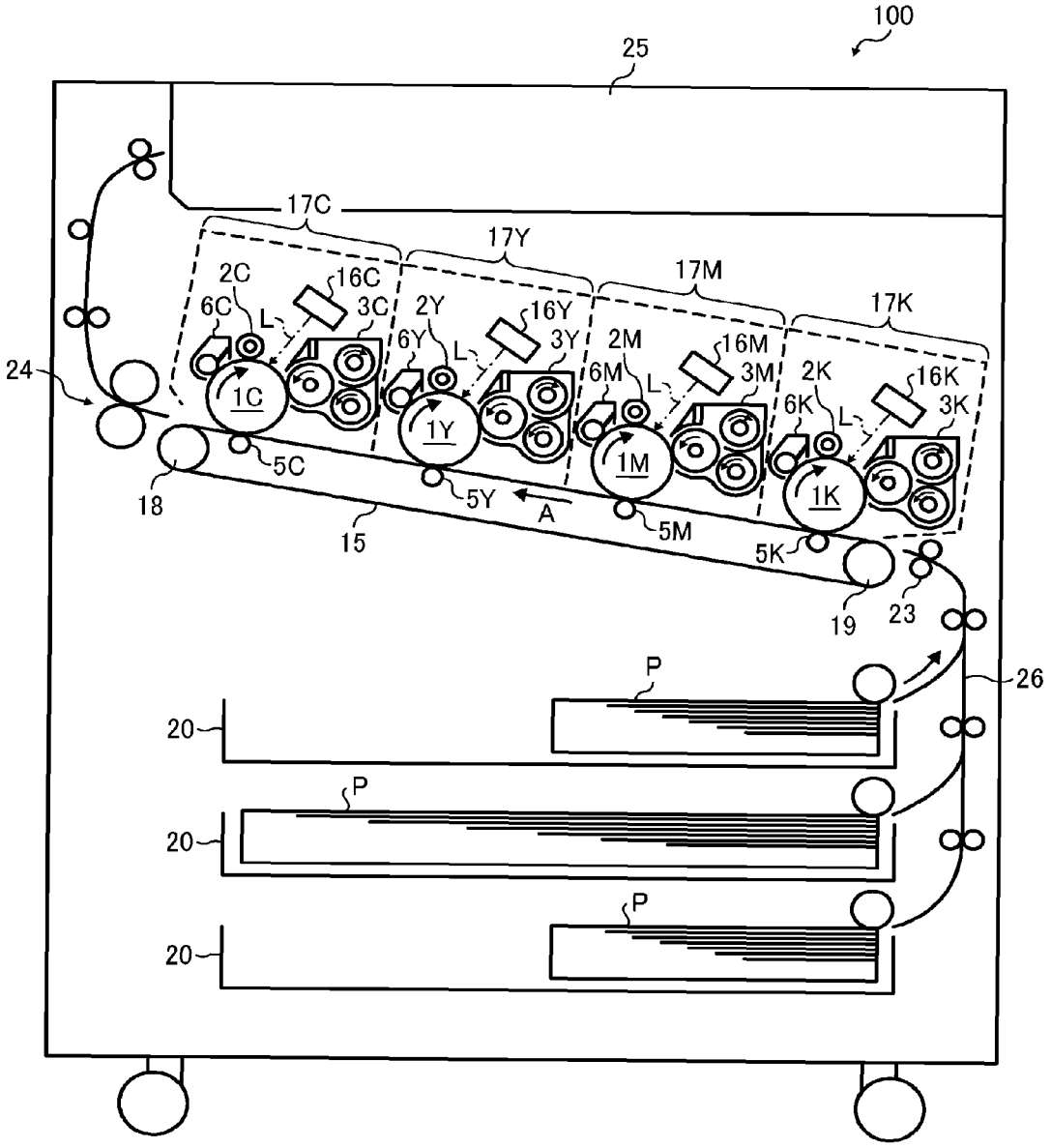
FIG. 1 is a schematic view of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, Descriptions are given below of an image forming apparatus 100 according to an embodiment, which is a printer for example.

FIG. 1 is a schematic diagram illustrates a configuration of the image forming apparatus 100 according to the present embodiment.

The image forming apparatus 100 is a tandem-type multicolor image forming apparatus and includes four process cartridges 17K, 17M, 17Y, and 17C (also collectively "process cartridges 17") to form black (K), magenta (M), yellow (Y), and cyan (C) single-color toner images, respectively. An endless transfer-transport belt 15 is disposed below the process cartridges 17 and winds around a downstream support roller 18 and an upstream support roller 19. The transfer-transport belt 15 rotates in the direction indicated by arrow A illustrated in FIG. 1 (hereinafter "belt travel direction") while carrying a recording sheet P (recording medium) on the outer side thereof. Transfer bias rollers 5K, 5M, 5Y, 5C are disposed facing the respective process cartridges 17K, 17M, 17Y, and 17C via the transfer-transport belt 15.

The image forming apparatus 100 further includes a fixing device 24, disposed downstream from the downstream support roller 18 in the belt travel direction, and an output tray 25 disposed on an upper side of the body of the image forming apparatus 100. The fixing device 24 fixes a toner image on the recording sheet P after the recording sheet P is separated from the transfer-transport belt 15, after which the recording sheet P is ejected to the output tray 25.

The image forming apparatus 100 further includes multiple sheet trays 20 each containing multiple recording sheets P, a sheet feeder 26, and a registration roller pair 23. The sheet feeder 26 feeds the recording sheets P from the sheet tray 20 to a transfer range where the transfer-transport belt 15 faces the process cartridges 17. The registration roller pair 23 forwards the recording sheet P sent from the sheet tray 20 to the transfer range, timed to coincide with image forming timings of the process cartridges 17.

In the configuration illustrated in FIG. 1, the transfer-transport belt 15 is disposed obliquely to reduce the lateral length in FIG. 1 of the image forming apparatus 100, and accordingly the belt travel direction indicated by arrow A is oblique. With this configuration, the width (lateral length in FIG. 1) of the image forming apparatus 100 is reduced to a length slightly greater than the long-side length of A3 size. In other words, the width of the image forming apparatus 100 is significantly reduced to a length only necessary to contain the sheets.

The process cartridges 17K, 17M, 17Y, and 17C respectively include drum-shaped photoconductors 1K, 1M, 1Y, and 1C (collectively "photoconductors 1"), which serve as image bearers. The process cartridges 17K, 17M, 17Y, and 17C respectively include chargers 2K, 2M, 2Y, and 2C (collectively "chargers 2"), developing devices 3K, 3M, 3Y, and 3C (collectively "developing devices 3"), and cleaning devices 6K, 6M, 6Y, and 6C (collectively "cleaning devices 6"), which are disposed around the photoconductors 1K, 1M, 1Y, and 1C in the direction of rotation of the photoconductors 1K, 1M, 1Y, and 1C. Each process cartridge 17 is configured such that a surface of the photoconductor 1 between the charger 2 and the developing device 3 is irradiated with writing light L (e.g., a laser beam) from the corresponding one of exposure devices 16K, 16M, 16Y, and 16C (collectively "exposure devices 16"). It is to be noted that, instead of the drum shape, belt-type photoconductors can be used.

When users instruct the start of image formation to the above-described image forming apparatus 100, each process cartridge 17 starts forming a single-color toner image. In each process cartridge 17, the photoconductor 1 is rotated by a main motor and is charged uniformly by the charger 2 (i.e., a charging process). Subsequently, the exposure device 16 directs the writing beam L onto the photoconductor 1 according to image data of each color decomposed from multicolor image data, thus forming an electrostatic latent image on the photoconductor 1. The latent image is then developed by the developing device 3. Thus, single-color toner images are formed on the photoconductors 1K, 1M, 1Y, and 1C. Meanwhile, the sheet feeder 26 feeds the recording sheets P from one of the sheet trays 20 to the registration roller pair 23, which forwards the recording sheet P to the transfer-transport belt 15, timed to coincide with the image forming timings of the respective process cartridges 17. Then, the transfer-transport belt 15 transports the recording sheet P to the transfer range of each color.

In the transfer ranges where the photoconductors 1 face the respective transfer bias rollers 5 via the transfer-transport belt 15, the transfer bias rollers 5 sequentially transfer the toner images from the photoconductors 1 onto the recording sheet P on the transfer-transport belt 15. Thus, the black, magenta, yellow, and cyan toner images are sequentially transferred from the photoconductors 1K, 1M, 1Y, and 1C and superimposed one on another on the recording sheet P, forming a multicolor toner image on the recording sheet P.

The recording sheet P carrying the multicolor toner image is then separated from the transfer-transport belt 15, and the fixing device 24 fixes the toner image on the recording sheet P, after which the recording sheet P is ejected to the output tray 25.

After the toner image is transferred from each photoconductor 1, the cleaning device 6 removes toner remaining thereon, and a discharge lamp removes electrical potentials remaining on the photoconductor 1 as required. Then, the charger 2 again charges the surface of the photoconductor 1.

Although the process cartridges 17K, 17M, 17Y, and 17C are arranged in the order of black, magenta, yellow, and cyan in the belt travel direction in the configuration illustrated in FIG. 1, the order of arrangement is not limited thereto. For example, in another embodiment, the process cartridge 17K for black is disposed extreme downstream in the belt travel direction, and the process cartridges 17M, 17Y, and 17C are disposed in that order upstream from the process cartridge 17K.

The process cartridges 17 are described in further detail below.

The process cartridges 17K, 17M, 17Y, and 17C have a similar configuration except that the colors of the toner (i.e., an image forming material) used in the developing devices 3 are different. Therefore, subscripts K, M, Y, and C attached to reference numerals are omitted in the description below when color discrimination is not necessary.

Figure 2:
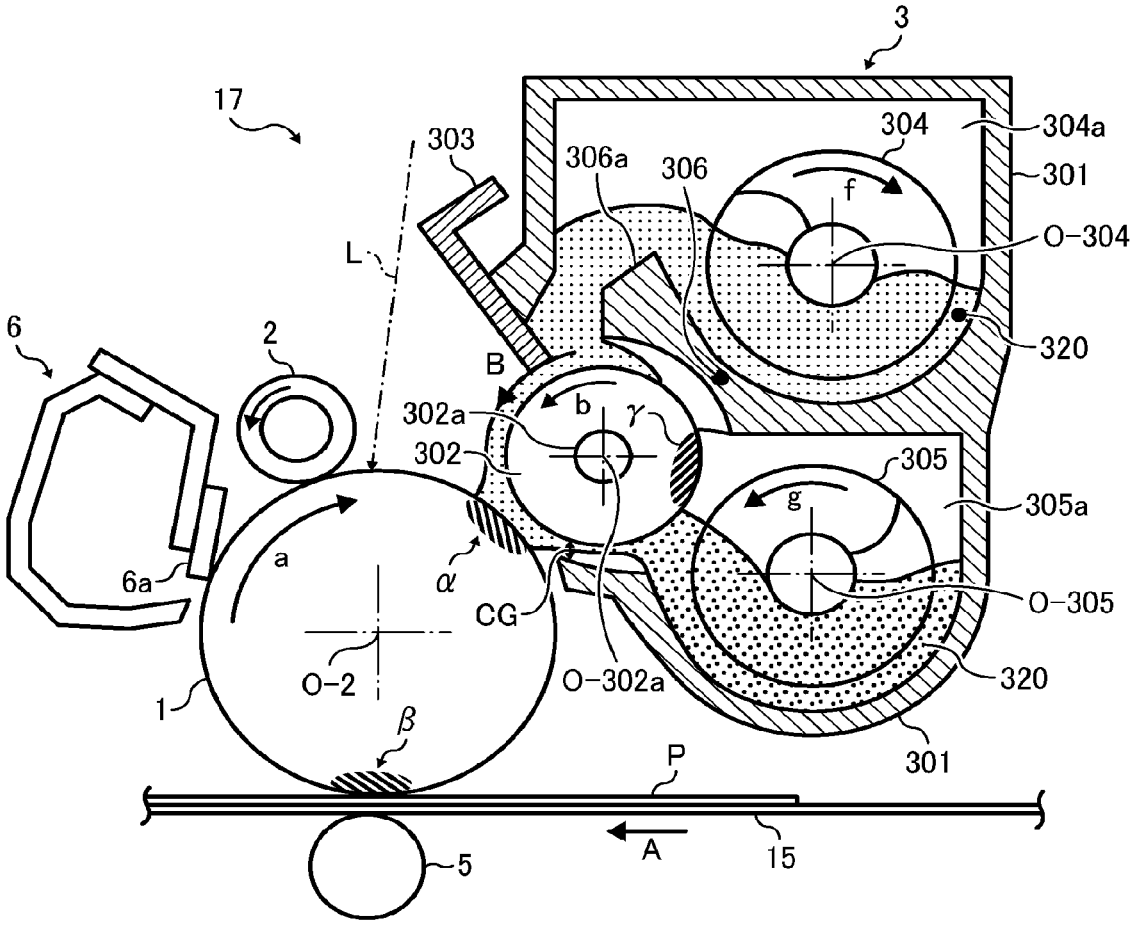
FIG. 2 is a schematic cross-sectional view illustrating a process cartridge of the image forming apparatus illustrated in FIG. 1.

FIG. 2 is a schematic view illustrating a configuration of the process cartridge 17 including the developing device 3 usable in the image forming apparatus 100 according to the present embodiment. In FIG. 2, reference character O-2 represents a center (i.e., an axis) of the photoconductor 1.

The developing device 3 is disposed facing the photoconductor 1 that rotates clockwise in FIG. 2, as indicated by arrow a. The charger 2 is positioned above the photoconductor 1, at about twelve o'clock from the photoconductor 1 in FIG. 2. Although the charger 2 in the present embodiment is a rotary body rotating at an identical velocity to that of the photoconductor 1, alternatively, a corona discharge-type charger can be used.

After the charger 2 charges the surface of the photoconductor 1 uniformly in the dark, the exposure device 16 directs the writing light L to the photoconductor 1, thus forming an electrostatic latent image thereon. As the photoconductor 1 rotates, the electrostatic latent image moves downstream to the developing device 3, which is on the right of the photoconductor 1 in FIG. 2. The developing device 3 includes a casing 301 serving as a developer container for containing developer 320. The casing 301 contains developer conveyors 304 and 305 to stir and transport the developer 320, a developing roller 302 serving as a developer bearer, and a partition 306 to divide, at least partly, an interior of the casing 301 into a supply compartment 304*a* where the developer conveyor 304 is disposed and a collecting compartment 305*a* where the developer conveyor 305 is disposed.

The developing roller 302 is disposed facing and adjacent to the photoconductor 1 to generate a developing range α. In FIG. 2, the developing roller 302 at a position between two o'clock and three o'clock (haft past two) of the photoconductor 1. The casing 301 has an opening at the position facing the photoconductor 1 to expose the developing roller 302. The term "developing range α" means a range where the developer 320 on the developing roller 302 contacts the surface of the photoconductor 1.

As the developing roller 302 rotates in the direction indicated by arrow b illustrated in FIG. 2, the developer 320 contained in the casing 301 is carried on the surface of the developing roller 302 and transported to the developing range α as indicated by arrow B. In the developing range α, toner in the developer 320 adheres to the electrostatic latent image on the surface of the photoconductor 1, thus developing the latent image into a toner image. As the photoconductor 1 rotates, the toner image moves downstream in the direction of rotation of the photoconductor 1 to a transfer range 13 facing the transfer bias roller 5. The transfer bias roller 5 is positioned below the photoconductor 1 at six o'clock of the photoconductor 1 in FIG. 2. Although the transfer device according to the present embodiment uses rotators, namely, the transfer bias rollers 5, alternatively, a corona discharge-type transfer device can be used.

In the transfer range 13, the toner image is transferred from the photoconductor 1 onto the recording sheet P. In the present embodiment, the toner image on the photoconductor 1 is directly transferred to the recording sheet P. Regarding the configuration to transfer the toner image onto a recording sheet, there are image forming apparatuses employing intermediate transferring, in which toner images are primarily transferred from the photoconductors and superimposed one on another into a multicolor toner image on an intermediate transfer member (e.g., an intermediate transfer belt or an intermediate transfer drum), after which the superimposed toner images are transferred onto the recording sheet at a time. In this case, the toner image on the photoconductor 1 is transferred onto the intermediate transfer member in the transfer range β.

Subsequently, the surface of the photoconductor 1 that has passed through the transfer range β reaches a position facing the cleaning device 6 as the photoconductor 1 rotates. The cleaning device 6 is positioned at ten o'clock of the photoconductor 1 in FIG. 2. The cleaning device 6 includes a cleaning blade 6*a* to remove toner remaining on the surface of the photoconductor 1 after the toner image is transferred therefrom onto the recording sheet P in the transfer range α. The surface of the photoconductor 1 that has passed through the range facing the cleaning device 6 is again charged by the charger 2 uniformly. Then, image formation is repeated.

The developing device 3 according to the present embodiment is combined in image forming apparatuses that optically write latent images, with the writing light L, on the photoconductors 1 as illustrated in FIGS. 1 and 2. More specifically, the charger 2 charges the photoconductor 1 uniformly to a negative electrical potential, and an image portion is exposed with the writing light L to reduce the negative electrical potentials. Then, the image portion (an electrostatic latent image) that has a reduced electrical potential is developed with negative toner. This method is called "reversal development". It is to be noted that charging potentials applied to the surface of the photoconductor 1 can be either negative or positive in configurations to which one or more aspects of this specification are applied.

Next, the developing device 3 is described in further detail below.

As illustrated in FIG. 2, the developing device 3 includes the developing roller 302, the developer conveyors 304 and 305, and a developer regulator 303, which are disposed inside the casing 301. The developer 320 is circulated inside the casing 301.

In the present embodiment, the developer conveyors 304 and 305 are, for example, conveying screws, each of which includes a rotation shaft and spiral-shaped blade winding around the shaft to transport developer axially by rotation. The external diameter of the spiral blade is smaller than about 16 mm, for example.

Figure 3:
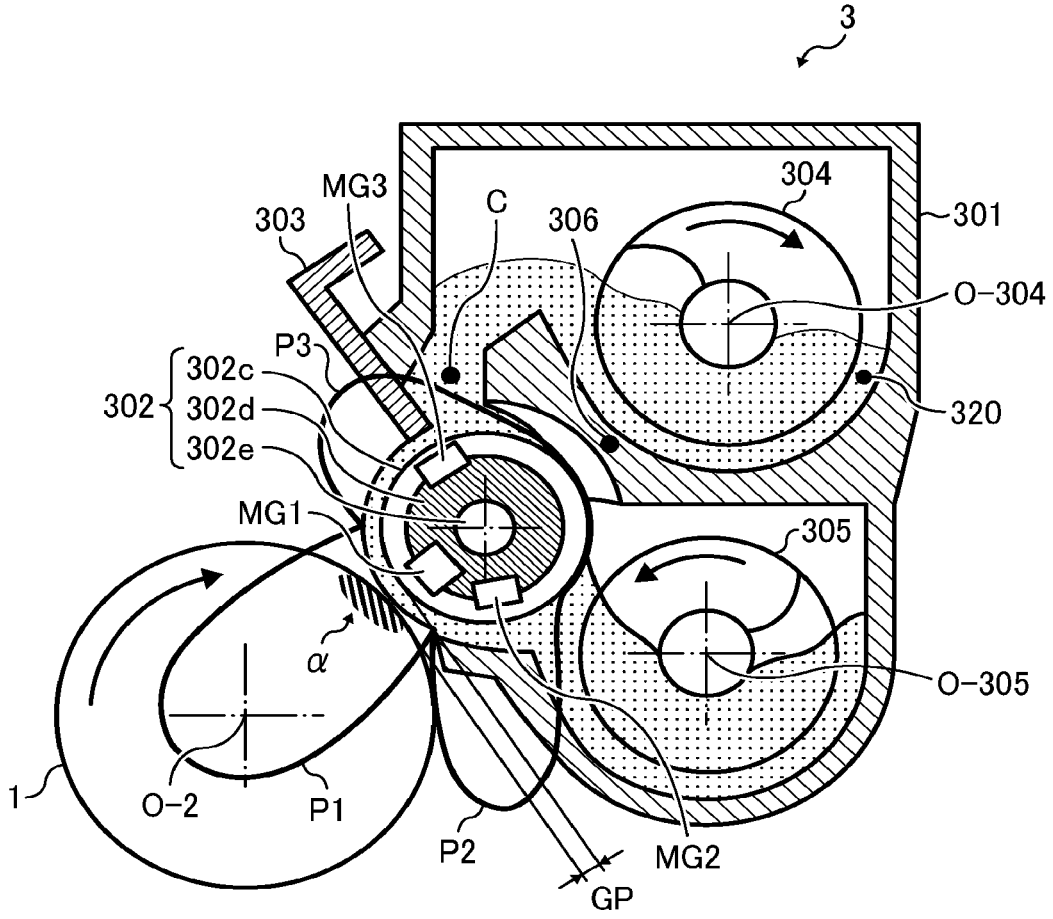
FIG. 3 is an end-on axial view illustrating a developing device and a photoconductor, together with distribution of magnetic flux density on a developing roller, according to an embodiment.

FIG. 3 is an end-on axial view of the developing device 3 and the photoconductor 1, together with the distribution of magnetic flux density in the direction normal to the developing roller 302.

As illustrated in FIG. 3, a stationary magnet roller 302*d* is disposed inside the developing roller 302. The magnet roller 302*d* includes multiple magnets MG1, MG2, and MG3 (also collectively "magnets MG") arranged in the circumferential direction thereof (in the shape of arc). Around the magnet roller 302*d*, a cylindrical developing sleeve 302*c* rotates together with a rotation shaft 302*e*. The developing sleeve 302*c* is made of nonmagnetic metal such as aluminum although other materials can be included. The magnet roller 302*d* is secured to a stationary part, such as the casing 301, so that each magnet MG is oriented in a predetermined direction. In the developing roller 302, the developing sleeve 302*c* rotates around the stationary magnet roller 302*d*, and the developing sleeve 302*c* bears and transports the developer 320 attracted by the magnets MG. Although separate magnets to generate multiple magnetic poles are disposed inside the developing roller 302, alternatively, for example, five magnetic poles can be magnetized on a magnetic roller.

Figure 4:
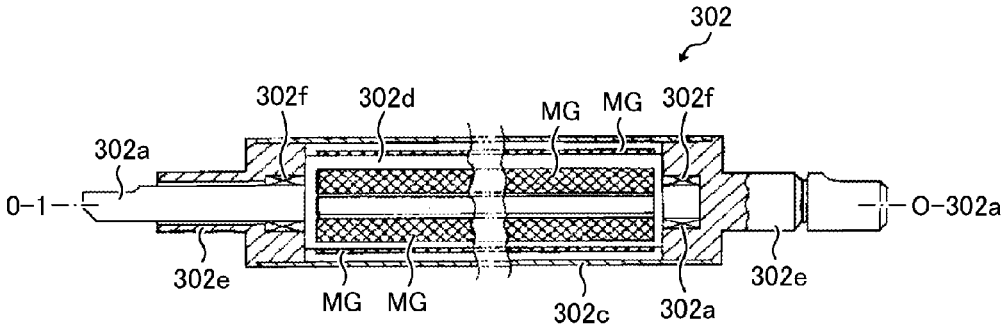
FIG. 4 is a cross-sectional view of a developing roller of the developing device, in parallel to the axis thereof.

FIG. 4 is a cross-sectional view of the developing roller 302 in parallel to the axis thereof.

As illustrated in FIG. 4, the developing roller 302 includes a stationary shaft 302*a* secured to the casing 301, the magnet roller 302*d* that is columnar and united to the stationary shaft 302*a*, the developing sleeve 302*c* overlaying the magnet roller 302*d* across a gap, and the rotation shaft 302*e* united to the developing sleeve 302*c*. The rotation shaft 302*e* is rotatable relative to the stationary shaft 302*a* via bearings 302*f*, driven with power transmitted from a driving device. As illustrated in FIG. 4, the three magnets MG (MG1, MG2, and MG3) are secured to the outer surface of the magnet roller 302*d* and arranged at predetermined intervals. The developing sleeve 302*c* is designed to rotate around the magnets MG. Although the three magnets MG are used, the number of the magnets secured to the magnet roller can be determined freely in accordance with machine structure.

The magnets MG of the magnet roller 302*d* generate a magnetic field to cause the developer 320 to stand on end on the surface of the developing sleeve 302*c* and a magnetic field to separate the developer 320 from the developing sleeve 302*c*. Magnetic carrier particles CG (indicated in FIG. 2) gather along the magnetic force lines generated by the magnets MG, forming a magnetic brush. With the multiple magnets MG of the magnet roller 302*d*, the magnetic fields generated on the surface of the developing sleeve 302*c* exhibits the distribution of magnetic flux density in the direction normal to the developing sleeve 302*c* as illustrated in FIG. 3.

In the developing device 3 according to the present embodiment, the magnet MG1 generates a development pole P1 (North pole or N pole). The magnet MG2 generates a conveyance pole P2 (South pole or S pole) to transport the developer into the casing 301 after used in image development. The magnet MG3 generates a regulation pole P3 (S pole) facing the developer regulator 303.

In the developing range α, the surface of the developing roller 302 is not in direct contact with the surface of the photoconductor 1 but faces the photoconductor 1 across a development gap GP having a predetermined distance suitable for image development. The development pole P1 causes the developer 320 (i.e., developer particles) to stand on end on the surface of the developing roller 302 so that the developer 320 contacts the surface of the photoconductor 1. Then, toner adheres to the electrostatic latent image on the photoconductor 1, developing the latent image.

The stationary shaft 302*a* of the developing roller 302 is connected to a grounded power source to output a developing bias. The power source connected to the stationary shaft 302*a* applies voltage to the developing sleeve 302*c* via the bearings 302*f* (illustrated in FIG. 4), which are conductive, and the conductive rotation shaft 302*e*. By contrast, a conductive support body, serving as an innermost layer, of the photoconductor 1 is grounded. This configuration causes an electrical field to convey the toner, separated from the carrier of the developer 320, toward the photoconductor 1 in the developing range α. The toner moves to the photoconductor 1 due to differences in electrical potential between the developing sleeve 302*c* and the electrostatic latent image on the surface of the photoconductor 1.

In the developing device 3, the magnetic field of the regulation pole P3 generated by the magnet MG3 attracts (e.g., scoops) the developer 320 from a storage space 301ST onto the surface of the developing roller 302. With the magnetic fields generated by the regulation pole P3 of the magnet MG3 and the development pole P1 of the magnet MG1, the developer 320 is retained on the developing roller 302 from the position where the developer 320 is supplied from the storage space 301ST to the developing range α. Further, with the magnetic fields generated by the development pole P1 of the magnet MG1 and the conveyance pole P2 of the magnet MG2, the developer 320 is retained on the developing roller 302 from the developing range α to the interior of the casing 301. In a releasing area γ, the developer 320 is separated from the developing roller 302 by a repulsive magnetic field generated by the magnets MG2 and MG3.

The density of toner in developer decreases after the toner therein moves to the photoconductor 1. Therefore, desired image density is not attained if the developer 320 having a reduced toner density is not separated from the developing roller 302 but is transported again to the developing range α and used in image development. This phenomenon is called "carryover of developer". To prevent carryover of developer, the developer 320 that has passed through the development range α is separated from the developing sleeve 302*c* in the releasing area γ. The developer 320 separated from the developing roller 302 is collected in the collecting compartment 305*a* (i.e., a collecting and conveying compartment) and mixed with the developer in the casing 301 so that the developer 320 has a desired toner density and a desired amount of electrical charges.

Subsequently, the developer 320 is supplied from the supply compartment 304*a* (i.e., a supply and conveying compartment) by the developer conveyor 304 (i.e., a supply screw) to the storage space 301ST. The developer conveyor 304 is disposed above the developing roller 302. Accordingly, to prevent the developer conveyor 304 from directly pushing the developer 320 into the storage space 301ST, the casing 301 includes a bank 306*a* so that the developer 320 supplied to the storage space 301ST is to overstride the bank 306*a*. It is to be noted that the bank 306*a* is a part of the partition 306.

After transported to the storage space 301ST, the developer 320 is borne on the developing sleeve 302*c* with the magnetic force of the regulation pole P3 generated by the magnet MG3. The developer regulator 303 is disposed adjacent to and downstream from a peak position of the regulation pole P3. As the developer 320 passes through the position facing the developer regulator 303, the developer 320 is adjusted to a predetermined thickness. Subsequently, the developer 320 forms a magnetic brush and is transported to the developing range α.

Figure 5:
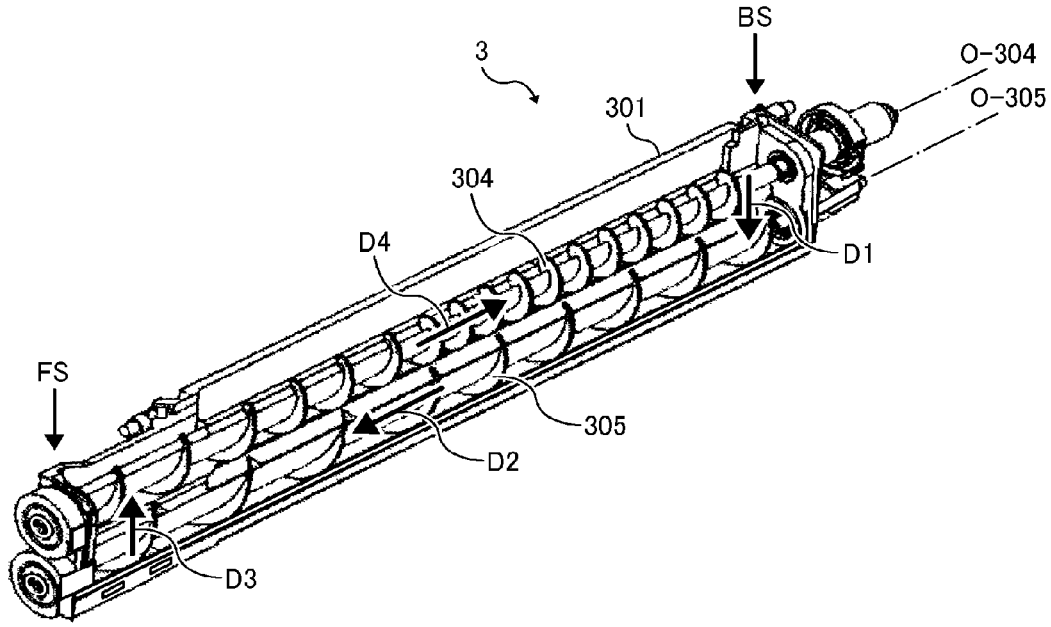
FIG. 5 is a perspective view illustrating interiors of a main part of the developing device.
Figure 6:
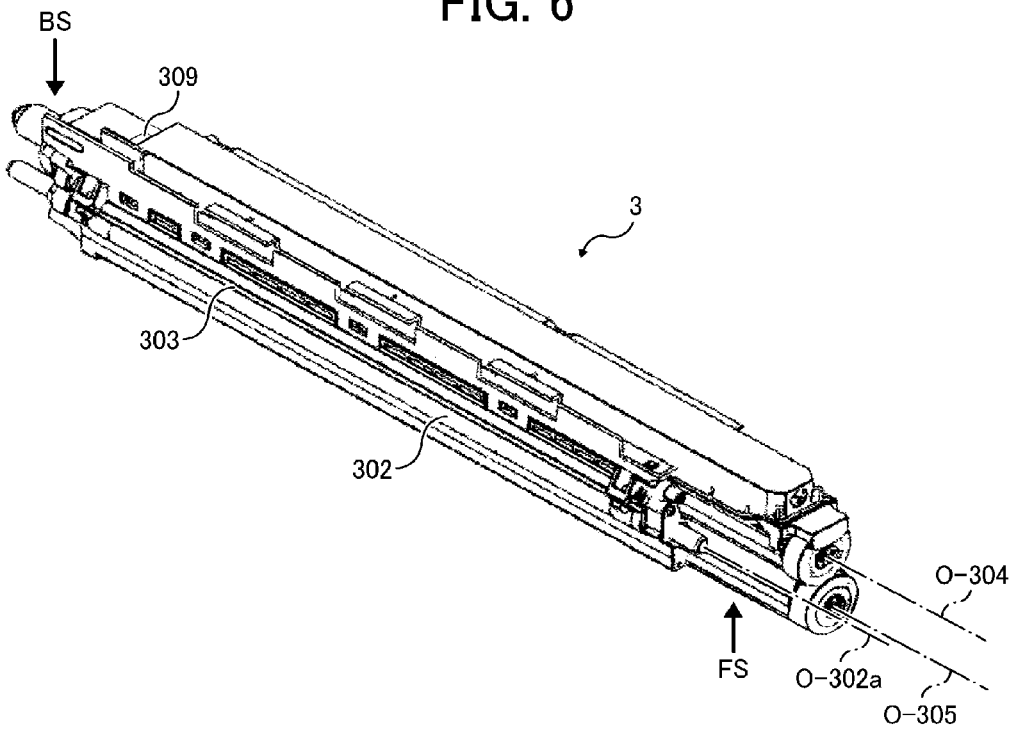
FIG. 6 is a perspective view illustrating an exterior of the main part of the developing device.
Figure 7:
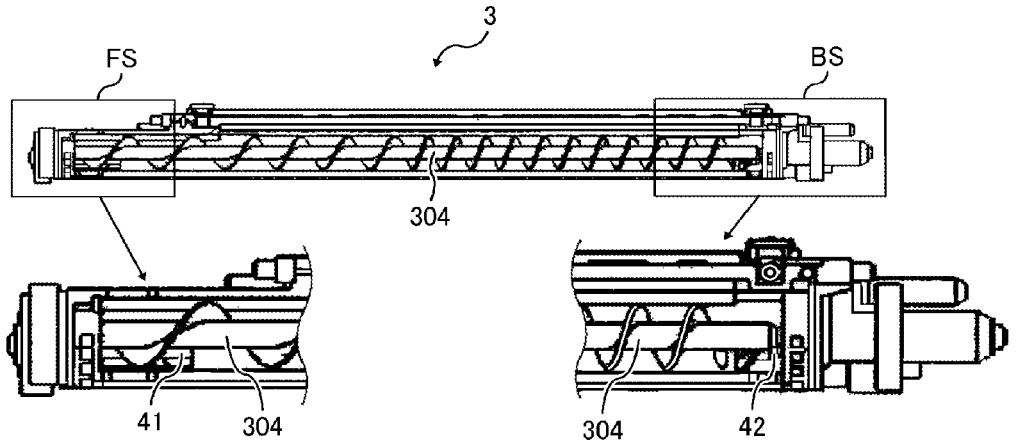
FIG. 7 illustrates communication portions (e.g., through holes) at longitudinal ends of a partition of the developing device, as viewed from above.

FIG. 5 is a perspective view of the interior of the developing device 3, and FIG. 6 is a perspective view that illustrates an exterior of a main part of the developing device 3. FIG. 7 illustrates communication openings 41 and 42 (e.g., through holes) in end portions of the partition 306 in the longitudinal direction of the developing device 3, as viewed from above. Arrows D1 to D4 illustrated in FIG. 5 represent the flow of the developer 320 inside the casing 301.

The developer conveyor 304 is positioned adjacent to the developing roller 302, at two o'clock of the developing roller 302 in FIGS. 2 and 3. Additionally, the developer conveyor 304 is positioned upstream from the developer regulator 303 in the direction of rotation of the developing roller 302. As illustrated in FIG. 5, the developer conveyor 304 is screw-shaped and includes the spiral blade winding around the rotation shaft. The developer conveyor 304 rotates clockwise as indicated by arrow f illustrated in FIGS. 2 and 3, around an axis O-304 (i.e., a centerline) parallel to an axis O-302*a* of the developing roller 302. Referring to FIG. 5, with this rotation, the developer 320 is transported along the axis O-304 in the longitudinal direction of the developing device 3, as indicated by arrow D4, from a front side FS (or a proximal side) to a back side BS (or a distal side) in FIG. 5. Hereinafter this direction is referred to as "front-back direction", which is identical to the front-back direction of the apparatus. That is, the developer conveyor 304 transports the developer 320 axially from the front side FS to the back side BS when a driving force is input to the rotation shaft thereof.

The developer conveyor 305 (i.e., a collecting screw) is positioned adjacent to the developing roller 302 and at four o'clock of the developing roller 302 in FIGS. 2 and 3. The developer conveyor 305 is adjacent to the releasing area γ. As illustrated in FIG. 5, the developer conveyor 305 is screw-shaped and includes the spiral blade winding around the rotation shaft. The developer conveyor 305 rotates counterclockwise as indicated by arrow g illustrated in FIGS. 2 and 3 around ana axis O-305 parallel to the axis O-302*a* of the developing roller 302. By rotating, the developer conveyor 305 stirs and transports the developer 320 from the back side BS to the front side FS in the longitudinal direction (front-back direction) of the developing device 3 along the axis O-305 as indicated by arrow D2. That is, when a driving force is input to the rotation shaft thereof, the developer conveyor 305 transports the developer 320 axially from the back side BS to the front side FS in the direction opposite the direction in which the developer conveyor 304 transports the developer 320.

Inside the casing 301, the supply compartment 304*a*, in which the developer conveyor 304 is disposed, is positioned above and adjacent via the partition 306 to the collecting compartment 305*a*, in which the developer conveyor 305 is disposed. As illustrated in FIGS. 5 and 6, the developer conveyors 304 and 305 slightly project beyond the end of the developing roller 302 on the front side FS to secure supply of the developer 320 from the supply compartment 304*a* to the front end of the developing roller 302. Additionally, the developer conveyors 304 and 305 extend beyond the end of the developing roller 302 on the back side BS to provide a space necessary for toner supply to be described later. The longitudinal length of the developer regulator 303 matches the length of the developing roller 302.

As illustrated in FIGS. 2 and 3, the partition 306 is disposed between the developer conveyor 304 and the developer conveyor 305 to separate the supply compartment 304*a* from the collecting compartment 305*a*. The partition 306 is supported by the inner faces of the casing 301. At both ends of the partition 306 in the longitudinal direction, the communication openings 41 and 42 are disposed. The developer 320 transported by the developer conveyor 305 from the back side BS to the front side FS (indicated by arrow D2 in FIG. 5) is piled against the side wall of the casing 301 at the downstream end in that direction. The developer 320 thus piled up is then brought up through the communication opening 41 (hereinafter also "developer-lifting opening 41") in the front end portion of the partition 306 (indicated by arrow D3 in FIG. 5) to the supply compartment 304*a*.

In the supply compartment 304*a*, the developer 320 is transported by the developer conveyor 304 from the front side FS to the back side BS (indicated by arrow D4 in FIG. 5). Similar to the collecting compartment 305*a*, the developer 320 transported by the developer conveyor 304 from the front side FS to the back side BS in the longitudinal direction is piled against the side wall of the casing 301 at the downstream end in that direction (on the back side BS). The developer 320 thus piled up then falls through the communication opening 42 (hereinafter also "developer-falling opening 42") in the back end portion of the partition 306 to the collecting compartment 305*a* as indicated by arrow D1 in FIG. 5. In the collecting compartment 305*a*, the developer 320 is again transported by the developer conveyor 305 to the front side FS as indicated by arrow D2 in FIG. 5.

Additionally, the supply compartment 304*a* is divided from the collecting compartment 305*a* by the partition 306 in the present embodiment. Therefore, only the developer 320 in which toner and carrier are mixed sufficiently can be supplied to the developing roller 302 by the developer conveyor 304. The developer 320 that has been used in image development, having a reduced toner density, is not immediately supplied to the developing roller 302 but is stirred by the developer conveyor 305. Accordingly, only the developer 320 having a desired toner density and including toner with a desired charge amount can be supplied to the developing roller 302 and used in image development, thus attaining high image quality.

Next, supply of toner to the developing device 3 is described in further detail below.

The toner in the developer 320 contained in the developing device 3 is consumed in image development, and accordingly toner is externally supplied to the developer 320 in the developing device 3. As illustrated in FIG. 6, a toner supply inlet 309 is positioned adjacent to the longitudinal end of the developing device 3 on the back side BS, and toner is externally supplied through the toner supply inlet 309. The back end of the developing device 3 corresponds to the downstream end of the supply compartment 304*a* from which the developer is supplied to the developing roller 302. Accordingly, the supplied toner is not immediately supplied to image development but is supplied through the developer-falling opening 42 to the collecting compartment 305*a*.

The toner supplied, together with the developer 320, to the collecting compartment 305*a* is mixed with the developer 320 therein by the developer conveyor 305. After the density of toner in the developer 320 is adjusted to a predetermined or desired density, the developer 320 is supplied through the developer-lifting opening 41 to the supply compartment 304*a* and used in image development. The collecting compartment 305*a*, in which the developer conveyor 305 is disposed, is for collecting the developer 320 separated from the developing roller 302 and transporting the developer 320. The developer 320 is not supplied from the collecting compartment 305*a* to the developing roller 302. Therefore, insufficiently agitated developer including fresh toner supplied through the toner supply inlet 309 is not supplied to image development. That is, developer in which the density of toner is uneven is not supplied. Accordingly, the developer 320 in which the toner density is uniform is used in image development to attain a stable image density.

The supplied toner fallen through the developer-falling opening 42 to the collecting compartment 305*a* is transported by the developer conveyor 305 to the front side FS as indicated by arrow D2 while being mixed with the developer 320 separated from the developing roller 302, in which the density of toner is reduced. Thus, while being transported to the downstream end of the collecting compartment 305*a*, which is on the front side FS of the developing device 3, the mixture of the supplied toner and the developer 320 in which the toner density is reduced is adjusted to have a proper toner density. Then, the developer 320 is transported through the developer-lifting opening 41 to the supply compartment 304*a*. In the supply compartment 304*a*, the developer conveyor 304 supplies the developer 320 to the developing roller 302 while transporting the developer 320 to the back side BS of the developing device 3 as indicated by arrow D4 in FIG. 5.

In the present embodiment, the two magnets MG2 and MG3 having an identical polarity are disposed inside the developing roller 302 and adjacent to each other in the direction of rotation of the developing roller 302 to generate the repulsive magnetic field. The repulsive magnetic field acts in the releasing area γ on the developing roller 302. The repulsive magnetic field separates the developer that has been used in image development from the developing roller 302 in the releasing area γ, and the developer is collected in the collecting compartment 305*a* different from the supply compartment 304*a*. In such a supply-collection separation method, the density of toner in the developer flowing in the supply compartment 304*a* is kept constant throughout the developer conveyance direction. Thus, in the developer supplied to the developing range, uneven toner density in the axial direction of the developer bearer is suppressed.

Figure 8:
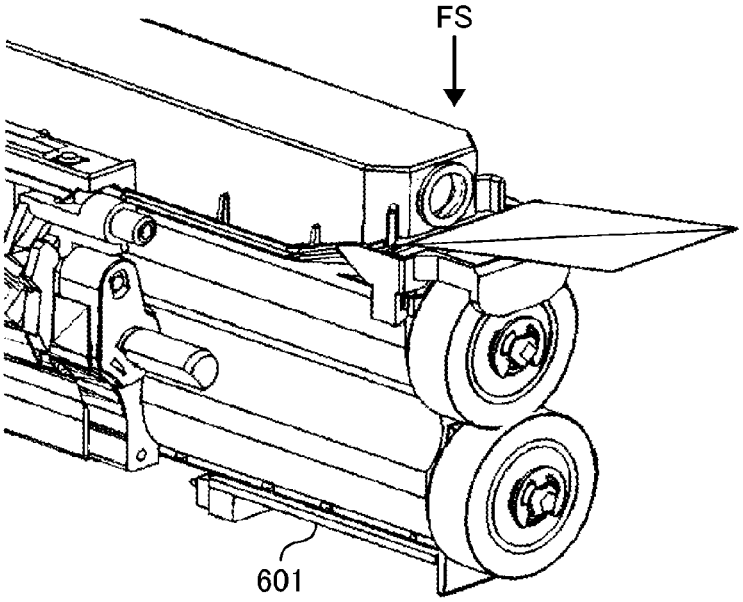
FIG. 8 is a perspective view of the developing device as viewed from a front side or a proximal side.
Figure 9:
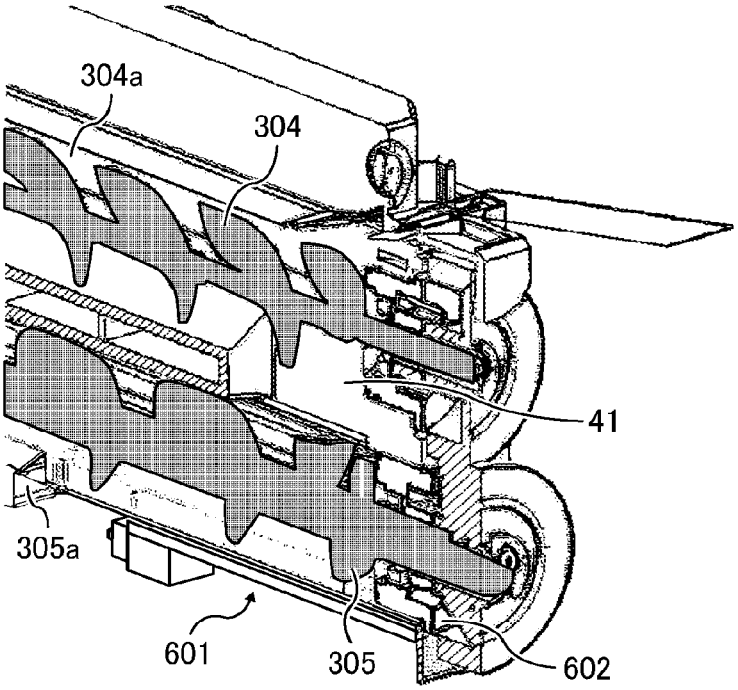
FIG. 9 is a perspective cross-sectional view of the front side of the developing device.

FIG. 8 is a perspective view of the front side FS of the developing device 3. FIG. 9 is a perspective cross-sectional view of the front side FS of the developing device 3.

Figure 10:
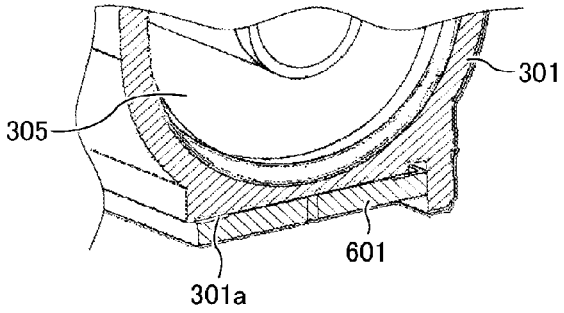
FIG. 10 is an enlarged perspective view of the front side of the developing device.

As illustrated in FIGS. 8 and 9, a toner density sensor 601 is attached to the front end of the bottom face of the casing 301. The toner density sensor 601 detects the percentage of toner or density of toner in developer. Specifically, the casing 301 includes a sensor mounting portion 301*a* that is flat as illustrated in FIG. 10. The toner density sensor 601 is secured to the flat sensor mounting portion 301*a* via double-sided adhesive tape or glue.

Figure 11A:
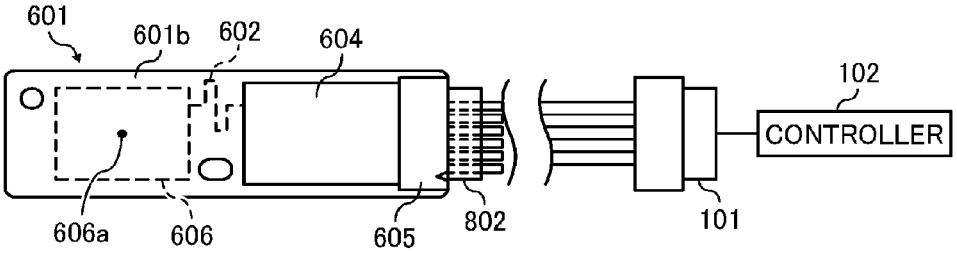
FIGS. 11A, 11B, and 11C are schematic views of a toner density sensor according to an embodiment.
Figure 11B:
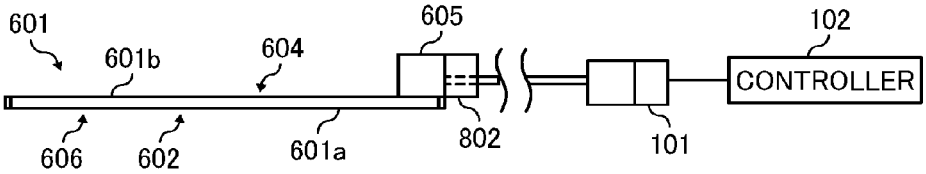
Figure 11C:
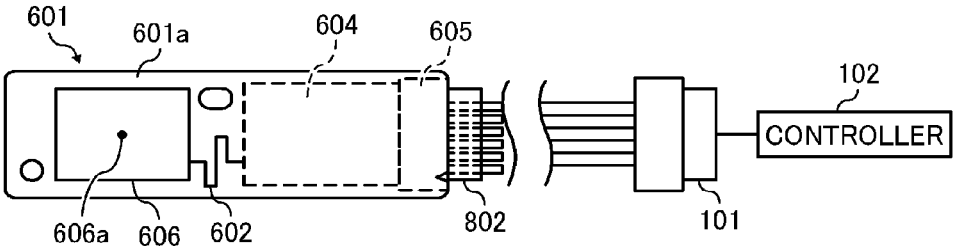

FIGS. 11A, 11B, and 11C are schematic views of the toner density sensor 601. FIG. 11A illustrates an electrical-component mounting face 601*b* of the toner density sensor 601. FIG. 11B is a side view of the toner density sensor 601. FIG. 11C illustrates a detection face 601*a* of the toner density sensor 601.

The toner density sensor 601 is a magnetic permeability sensor to detect a magnetic permeability of developer. The toner density sensor 601 includes a board having the detection face 601*a*, on which a coil pattern 606 (i.e., a planar coil) and the resistor pattern 602 (i.e., a planar resistor) are disposed as illustrated in FIG. 11C. The coil pattern 606 and the resistor pattern 602 are connected in series with each other and printed (by patterning) on the detection face 601*a*. The board has a through hole 606*a*, and the coil pattern 606 is a flat spiral pattern of signal wire winding around the through hole 606*a*. Additionally, the resistor pattern 602 is made of signal wire printed in a serpentine or zigzag pattern on the board, and the magnetic permeability detection is implemented by these patterns. The coil pattern 606 is disposed in the left of a center of the board in the longitudinal direction thereof in FIGS. 11A through 11C.

The coil pattern 606, which is a planar pattern of signal wire printed on the detection face 601*a*, has an inductance L attained by the coil. In the coil pattern 606, the inductance L changes in accordance with the magnetic permeability of a space opposing the detection face 601*a* on which the coil pattern 606 is printed. As a result, the toner density sensor 601 outputs signals at the frequency corresponding to the magnetic permeability of the space opposing the detection face 601 a bearing the coil pattern 606.

As illustrated in FIG. 11A, a connector 605 is disposed at the right end of the electrical-component mounting face 601*b* in FIG. 11A. The electrical-component mounting face 601*b* includes a layout area 604 on the right of the longitudinal center of the electrical-component mounting face 601*b* in FIGS. 11A through 11C. In the layout area 604, a capacitor, a resistor body, an integrated circuit (IC) chip, and the like are disposed. To the connector 605, a first end of a harness 802 (i.e., a wire piece) and the like are coupled. A second end of the harness 802 is coupled to an apparatus-side connector 101, which is electrically connected to a controller 102 of the image forming apparatus 100. The controller can be a computer including a central processing unit (CPU) and associated memory units (e.g., ROM, RAM, etc.). The computer performs various types of control processing by executing programs stored in the memory. Field programmable gate arrays (FPGA) may be used instead of CPUs.

Via the harness 802, detection signals are transmitted from the toner density sensor 601 to the controller 102. The capacitor disposed in the layout area 604 and the coil pattern 606 disposed on the detection face 601*a* together constitute a Colpitts-type LC oscillator circuit, and the capacitor is connected serially with the coil pattern 606 and the resistor pattern 602. A loop including the coil pattern 606, the resistor pattern 602, and the capacitor serves as a resonance current loop.

With the IC chip disposed in the layout area 604, fluctuations in potential of a part of the resonance current loop are output from the connector 605, as a rectangular wave corresponding to the resonance frequency. With this configuration, the toner density sensor 601 oscillates at the frequency corresponding to the inductance L, a resistance value $R_P$ of the resistor pattern 602, and a capacitance C of the capacitor.

As the density (percentage) of toner in developer changes, the state of the magnetic carrier adjacent to the toner density sensor 601 changes. The number of magnetic carrier particles present in the extent of the magnetic field of the coil pattern 606 differs according to the toner density (or toner density). That is, the magnetic permeability of developer inside the magnetic field of the coil pattern 606 differs according to the toner density. Accordingly, the magnetic permeability of the space opposing the board face bearing the coil pattern 606 changes according to the toner density. Consequently, the value of the inductance L of the coil pattern 606 changes according to the toner density in developer, and the resonance frequency changes according to the toner density in developer. Then, the rectangular wave in accordance with the resonance frequency is transmitted from the connector 605 via the harness 802 to the controller 102. The controller 102 includes a counter to count the number of times the rectangular wave from the toner density sensor 601 is received, and the controller 102 determines the toner density based on the count value.

Figure 12:
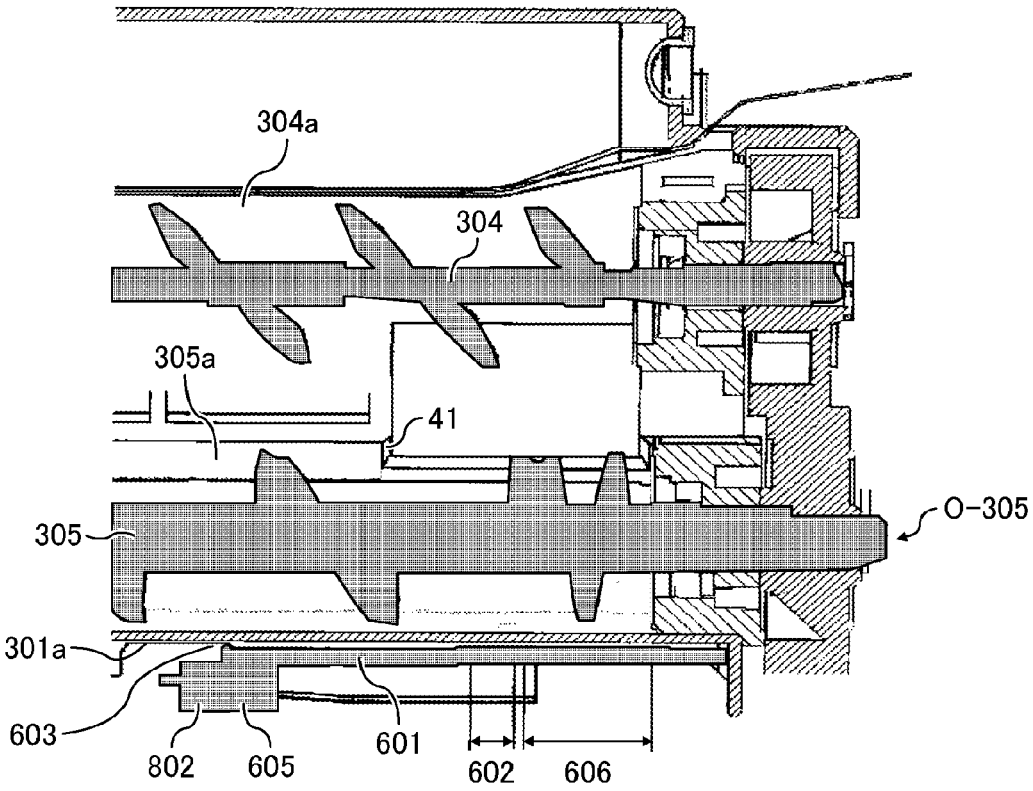
FIG. 12 is a cross-sectional view of the front side of the developing device.

To detect the toner density accurately, it is preferred that a constant amount of developer be present in the space opposing the coil pattern 606. Accordingly, in the present embodiment, as illustrated in FIG. 12, the toner density sensor 601 is secured to the front end of the bottom face of the casing 301 so that the toner density sensor 601 detects the toner density of the developer 320 at the downstream end of the collecting compartment 305*a* in the developer conveyance direction. It is to be noted that, hereinafter "downstream end of the collecting compartment 305*a*" means that in the developer conveyance direction in the collecting compartment 305*a*. As described above, at the downstream end of the collecting compartment 305*a*, the developer is blocked by the side wall of the casing 301. Then, the developer is piled up against the side wall and brought up through the developer-lifting opening 41 to the supply compartment 304*a*. Therefore, the downstream end of the collecting compartment 305*a* is constantly filled with the developer 320. That is, a constant amount of developer is constantly present in the space opposing the coil pattern 606, and the toner density can be detected with a high accuracy. In particular, in the present embodiment, the toner density sensor 601 is disposed such that the coil pattern 606, serving as a detecting portion, is adjacent to the side wall of the casing 301. With this placement, the coil pattern 606 is disposed facing the space adjacent to the downstream end of the collecting compartment 305*a*, which is filled with the developer 320 blocked by the side wall. Therefore, the coil pattern 606 faces the area that is constantly filled with a constant amount of the developer 320, and the toner density can be detected with a high accuracy.

Figure 13:
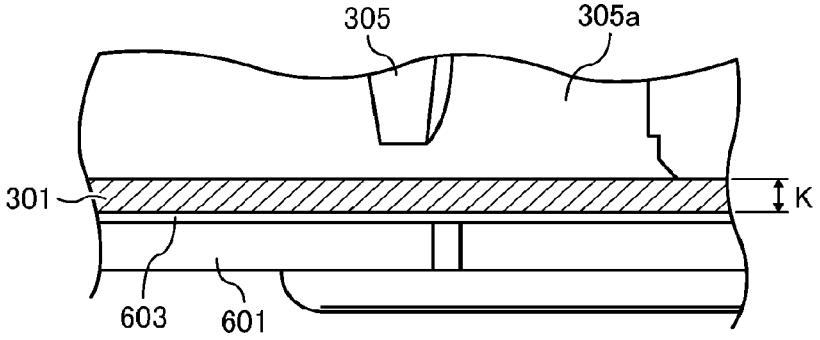
FIG. 13 is a schematic diagram illustrating a distance from the toner density sensor to a collecting compartment in the developing device illustrated in FIG. 12.

In FIG. 13, reference character "K" represents a total length including a thickness of the thickness of the bottom plate (e.g., the sensor mounting portion 301*a*) of the casing 301 and a thickness of an adhesive layer 603 to attach the toner density sensor 601 to the sensor mounting portion 301*a*. It is preferred that the total length K be 1.0 mm or smaller. In the present embodiment, the total length K is 0.8 mm, for example. When the total length K is 1.0 mm or smaller, the distance between the detection face 601*a* of the toner density sensor 601, which is secured to the sensor mounting portion 301*a*, and the developer inside the collecting compartment 305*a* is short. Accordingly, the toner density sensor 601 can preferably detect the magnetic permeability in the collecting compartment 305*a*.

Figure 14A:
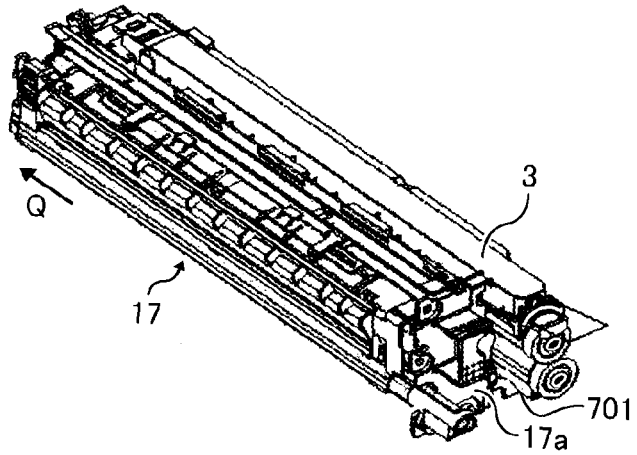
FIG. 14A is a perspective view of the process cartridge.
Figure 14B:
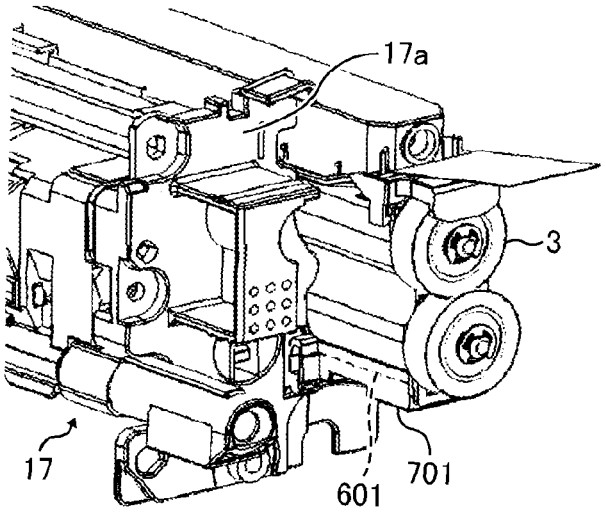
FIG. 14B is an enlarged perspective view of the front side of the process cartridge.
Figure 14C:
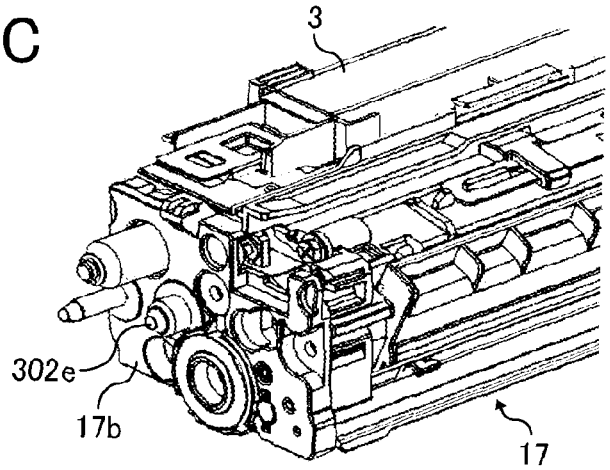
FIG. 14C is an enlarged perspective view of the back side of the process cartridge.

FIG. 14A is a perspective view of the process cartridge 17, FIG. 14B is an enlarged perspective view of the front side of the process cartridge 17, and FIG. 14C is an enlarged perspective view of the back side of the process cartridge 17.

The process cartridge 17 according to the present embodiment is removably mountable in the apparatus body. The process cartridge 17 is inserted into the apparatus from the front to the back of the apparatus in the direction indicated by arrow Q in FIG. 14A. The process cartridge 17 includes a front plate 17*a* (illustrated in FIGS. 14A and 14B) and a back plate 17*b* (illustrated in FIG. 14C), which determine the positions of the photoconductor 1 and the developing device 3. The front plate 17*a* and the back plate 17*b* serve as a common to support the developing device 3 together with the image bearer. Specifically, the front plate 17*a* and the back plate 17*b* rotatably support the photoconductor 1 while determining the position of the photoconductor 1.

Figure 31:
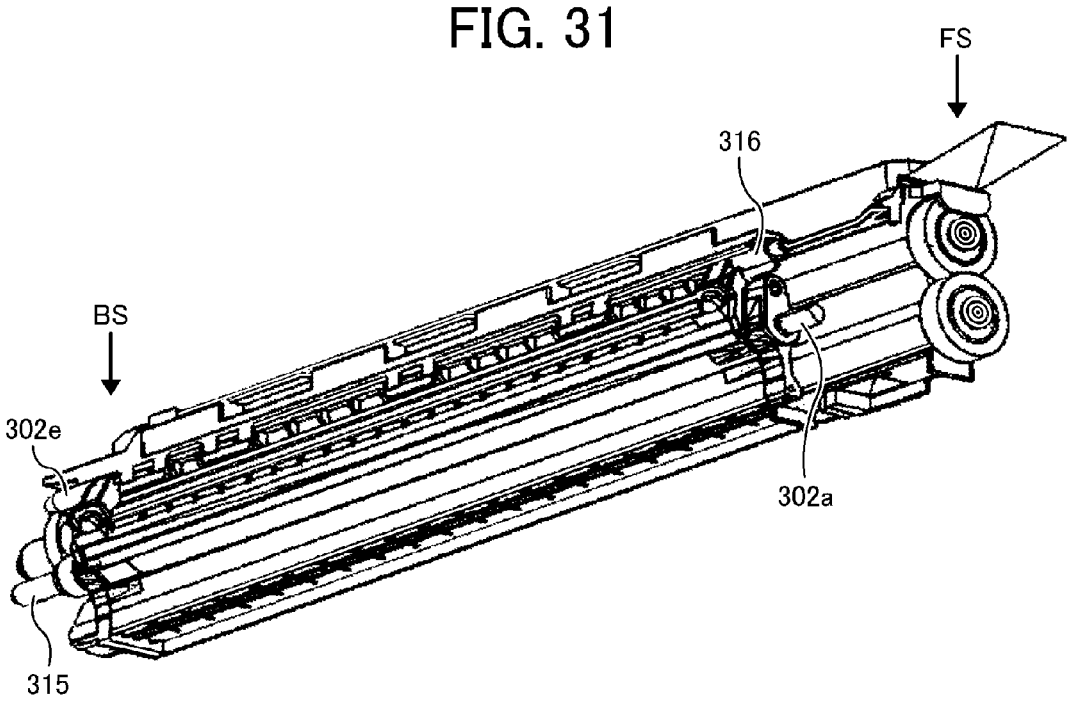
FIG. 31 is a perspective view of the developing device.

Referring to FIG. 31, on the back side BS of the developing device 3, the rotation shaft 302*e* of the developing roller 302, which is a main positioning reference, and a back-side positioning projection 315, which is a sub-positioning reference, project beyond the casing 301. On the front side FS of the developing device 3, the stationary shaft 302*a* of the developing roller 302, which is a main positioning reference, and a front-side positioning projection 316, which is a sub-positioning reference, project beyond the casing 301.

Figure 32:
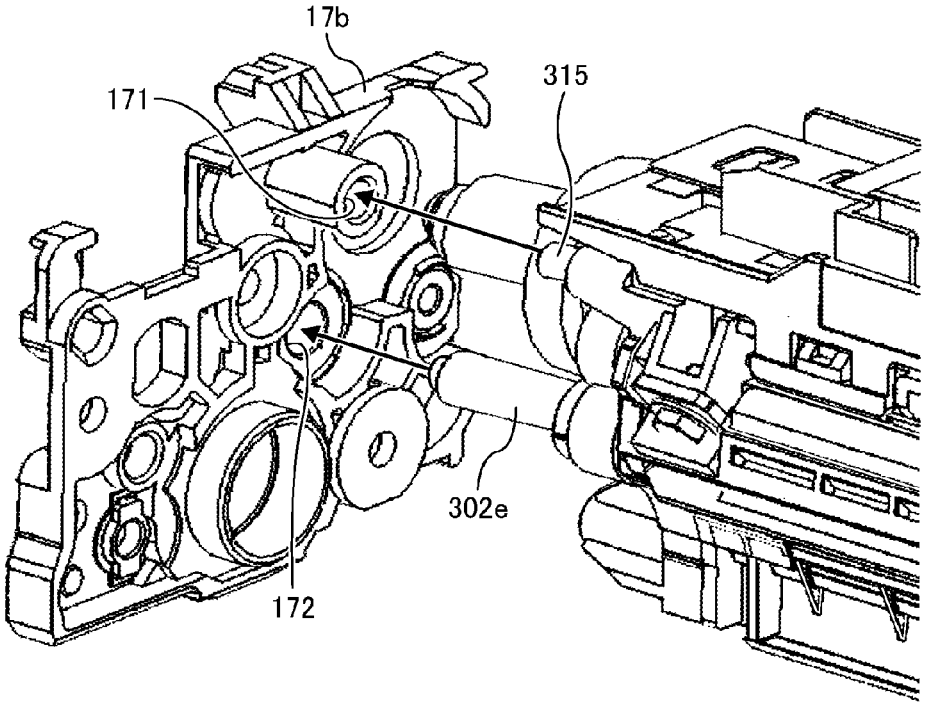
FIG. 32 is a perspective view of the developing device positioned on a back plate.

Referring to FIG. 32, as the rotation shaft 302*e* of the developing roller 302 is inserted into a bearing 172 attached to the back plate 17*b* and the back-side positioning projection 315 is inserted into a back-side positioning hole 171, the back side of the developing device 3 is positioned on the back plate 17*b*.

Figure 33:
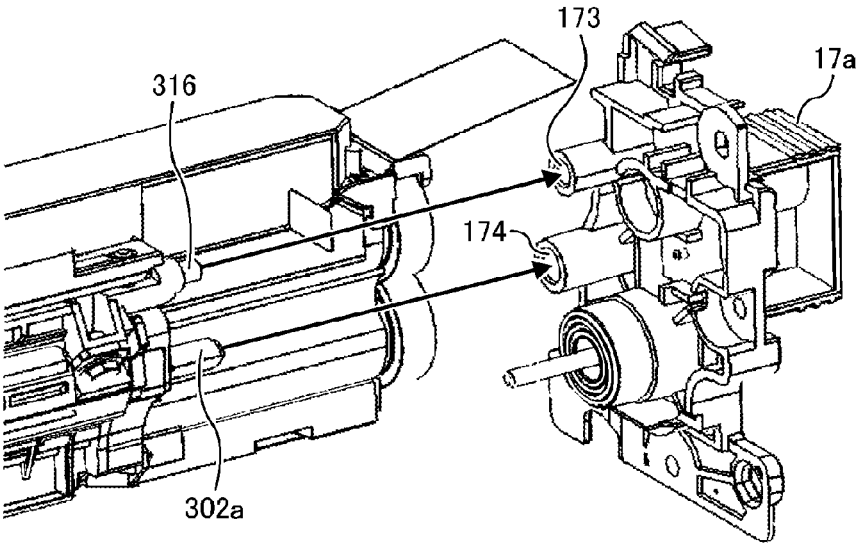
FIG. 33 is a perspective view illustrating positioning of the developing device relative to the back plate.

Referring to FIG. 33, as the stationary shaft 302*a* of the developing roller 302 is inserted into a shaft socket 174 of to the front plate 17*a* and the front-side positioning projection 316 is inserted into a front-side positioning hole 173, the front side of the developing device 3 is positioned on the front plate 17*a*.

Thus, since the photoconductor 1 and the developing device 3 are positioned on common components, the photoconductor 1 and the developing device 3 are held with the gap between the developing roller 302 and the photoconductor 1 kept at a predetermined size.

Figure 16:
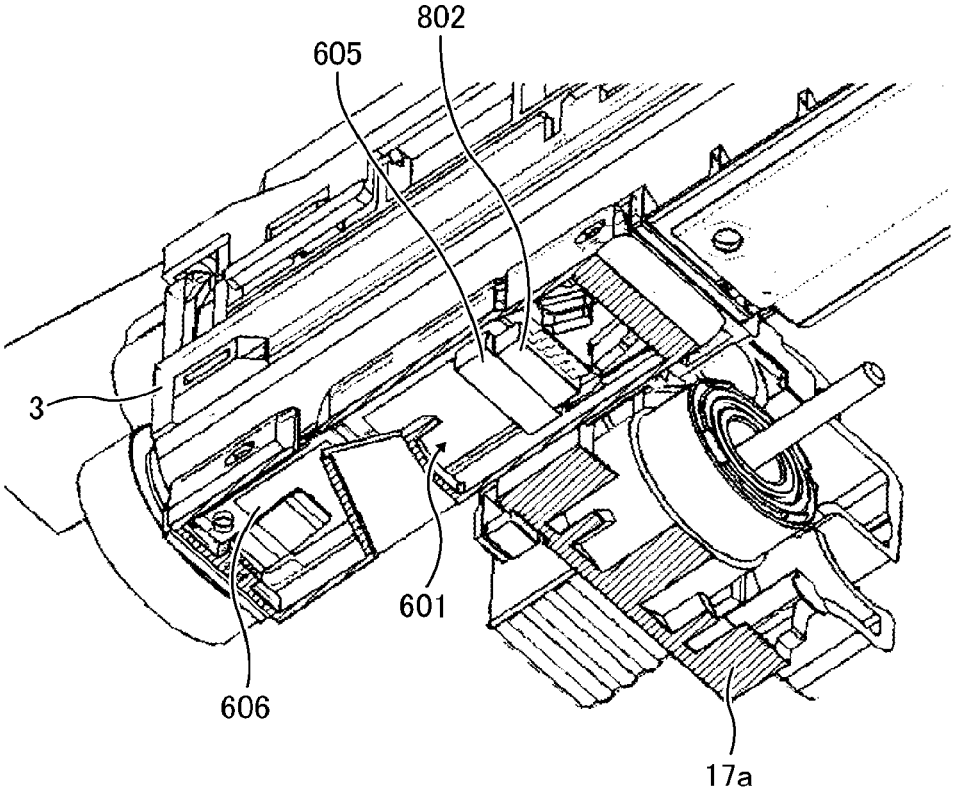
FIG. 16 is a perspective view illustrating relative positions of a connector of the toner density sensor illustrated in FIGS. 11A through 11C, the front plate, and an apparatus-side connector according to an embodiment.

In the present embodiment, to detect the toner density accurately, the toner density sensor 601 is disposed such that the coil pattern 606 to detect the toner density is adjacent to the side wall of the casing 301 as illustrated in FIG. 12. Consequently, the connector 605 is positioned on the inner side of the coil pattern 606 in the longitudinal direction. When the connector 605 is attached to a position inside the coil pattern 606 in the longitudinal direction, as illustrated in FIG. 16, the connector 605 is positioned inside the front plate 17*a* in the longitudinal direction.

Figure 34:
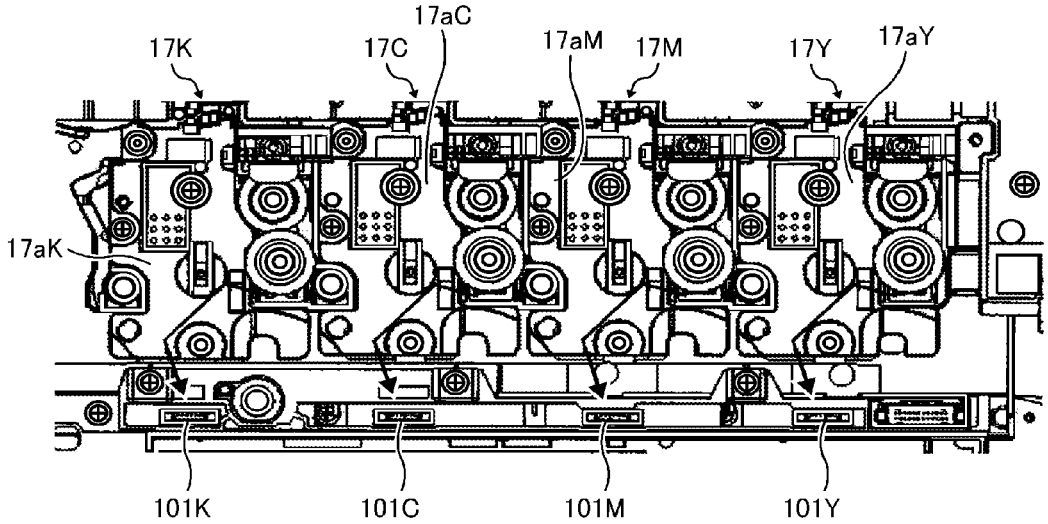
FIG. 34 is a side view illustrating the process cartridges and apparatus-side connectors according to an embodiment.

As illustrated in FIG. 34, the apparatus-side connector 101, which is electrically connected to the controller 102, is disposed below the photoconductor 1 in the apparatus body. That is, in the apparatus body, the apparatus-side connector 101 is disposed opposite the photoconductor 1 from the developing device 3. The second end of the harness 802 is coupled to the apparatus-side connector 101, and the first end of the harness 802 is coupled to the connector 605 of the toner density sensor 601.

In the present embodiment, the apparatus-side connector 101 is disposed below the photoconductor 1 due to layout limitations caused by a waste-toner passage through which the toner collected by the cleaning device 6 is transported to the waste toner container, the driving system to drive the transfer-transport belt 15, and the like.

From the controller 102, a driving current to drive the toner density sensor 601 and the like flows to the harness 802, and a magnetic field arises from the harness 802. From the coil pattern 606, the magnetic field arises to the side of the electrical-component mounting face 601*b* of the board in addition to the side of the detection face 601*a*. When the harness 802 is disposed within the magnetic field of the coil pattern 606, there is a risk that the magnetic field of the harness 802 hinders accurate detection of the magnetic permeability of the developer. Accordingly, the harness 802 is preferably disposed not to face the coil pattern 606.

As illustrated in FIG. 34, however, the gap between the adjacent process cartridges 17 is narrow, and it is difficult to dispose the harness 802 in the narrow gap between the process cartridges 17.

Figure 15A:
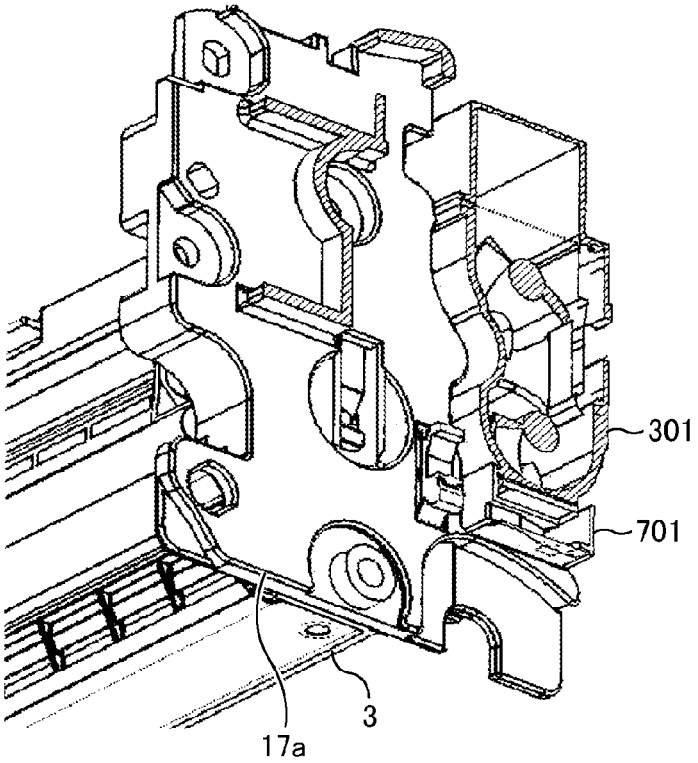
FIG. 15A is a perspective cross-sectional view of a front plate of the process cartridge and the developing device.
Figure 15B:
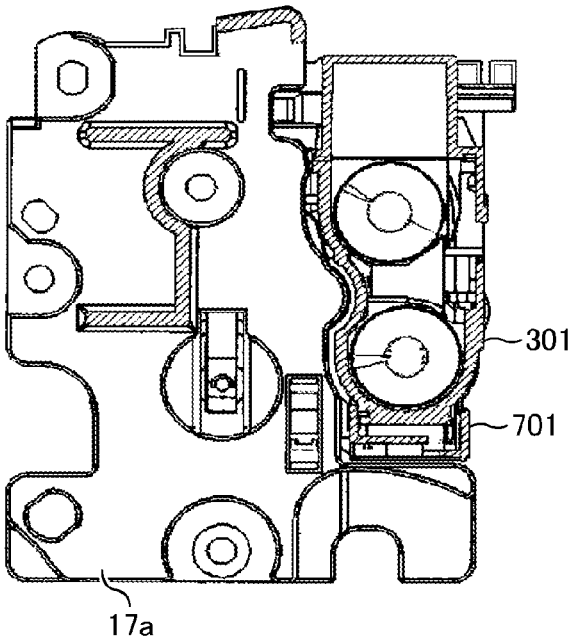
FIG. 15B is a front view of the front plate and the developing device.

Further, as illustrated in FIGS. 15A and 15B, the gap between the front plate 17*a* and the casing 301 of the developing device 3 is narrow as well. If the harness 802 is disposed between the front plate 17*a* and the casing 301, it is possible that the harness 802 contacts or interferes with the front plate 17*a*. Consequently, the gap between the developing roller 302 and the photoconductor 1 deviates from the predetermined size on the front side, adversely affecting image development.

To avoid such an inconvenience, it is conceivable to bend the harness 802 to the side opposite the photoconductor 1 so that the harness 802 goes along the casing 301, straight to the front side. When the harness 802 reaches a position outside the front plate 17*a* (beyond the front plate 17*a* in the longitudinal direction of the process cartridge 17), the harness 802 is laid, crossing (or overlapping) the toner density sensor 601 to the front side, and coupled to the apparatus-side connector 101 disposed below the photoconductor 1 as indicated by an arrow in FIG. 34.

In this placement, however, it is possible that the harness 802 crossing (the detection face 601*a*) of the toner density sensor 601 enters the magnetic field of the coil pattern 606, and the magnetic field of the harness 802 affects the detection of the magnetic permeability. Studying this inconvenience, the inventors have found the followings. When the harness 802 contacts the board of the toner density sensor 601, the magnetic field of the harness 802 significantly affects the detection of magnetic permeability of developer, thus degrading the detection accuracy. By contrast, when the harness 802 is moved away from the board of the toner density sensor 601, the effect of the magnetic field of the harness 802 is weakened, thus increasing the detection accuracy. However, even in the arrangement in which the harness 802 is disposed at a distance from the toner density sensor 601, when the harness 802 vibrates due to the vibration inside the apparatus caused by, for example, gear meshing, the magnetic field of the harness 802 disturbs the magnetic field of the coil pattern 606. Accordingly, the magnetic permeability of developer is not accurately detected.

In view of the foregoing, in the present embodiment, the harness 802 is disposed at a distance from the toner density sensor 601 and held to maintain the position of, at least, the portion of the harness 802 crossing the toner density sensor 601 (hereinafter "crossing portion" of the harness 802) relative to the coil pattern 606. This is described below with reference to drawings.

Figure 17:
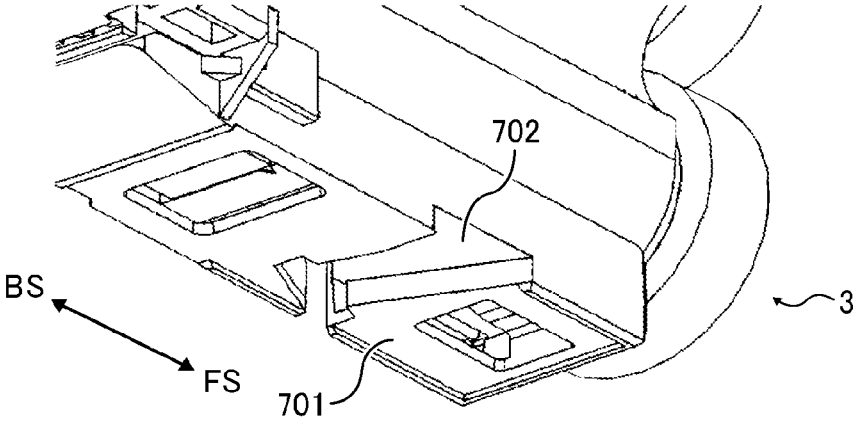
FIG. 17 is a perspective view, as viewed from the bottom, of a front end portion of the developing device.

FIG. 17 is a perspective view, as viewed from the bottom, of the front end portion of the developing device 3.

As illustrated in FIG. 17, the developing device 3 includes a nonmagnetic sensor cover 701 to cover the toner density sensor 601, and the sensor cover 701 has a retaining groove 702 to hold the crossing portion of the harness 802 crossing the toner density sensor 601. For example, the sensor cover 701 is made of plastic, such as acrylonitrile-butadiene-styrene (ABS) resin.

Figure 18:
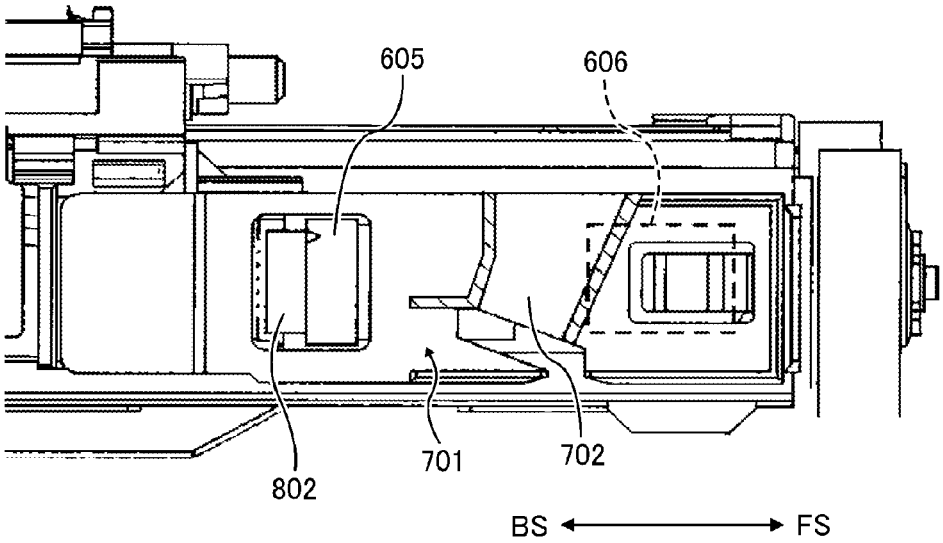
FIG. 18 is a bottom view of the developing device and illustrates relative positions of a retaining groove and the coil pattern of the toner density sensor.

FIG. 18 is a bottom view of the developing device 3 and illustrates relative positions of the retaining groove 702 and the coil pattern 606 of the toner density sensor 601.

As illustrated in FIG. 18, the retaining groove 702 partly faces (overlaps) the coil pattern 606 represented by broken lines in FIG. 18.

Figure 19:
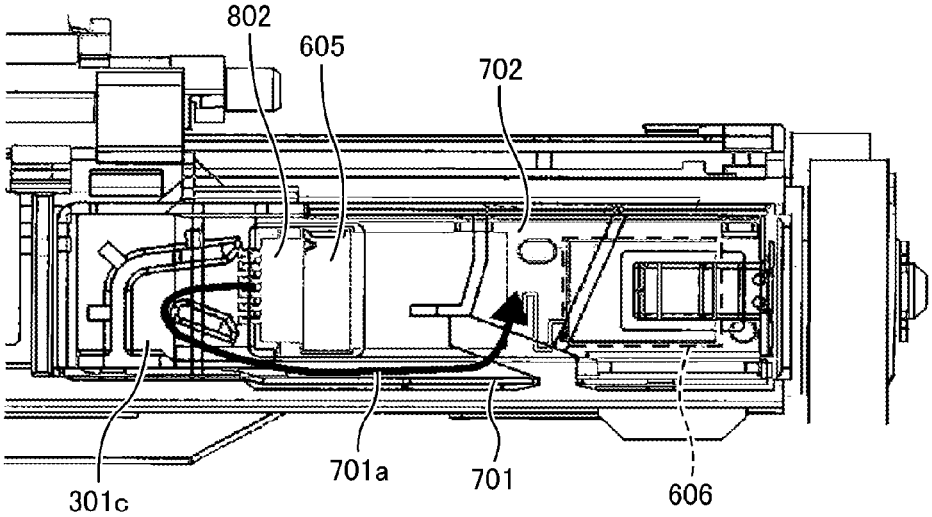
FIG. 19 illustrates wiring of a harness from the connector of the toner density sensor to the retaining groove, as viewed from the bottom of the developing device.

FIG. 19 illustrates wiring of the harness 802 from the first end coupled to the connector 605 to the retaining groove 702.

As illustrated in FIG. 19, the bottom face of the casing 301 includes a guide 301*c* for the harness 802. The harness 802 extending from the first end coupled to the connector 605 is inverted by the guide 301*c* and guided to a clearance 701*a* between a first lateral face (opposite the photoconductor 1) of the toner density sensor 601 and the sensor cover 701. It is to be noted that, the photoconductor 1 is located on the upper side in FIG. 19. Hereinafter, the side face of the toner density sensor 601 on the side of the photoconductor 1 is referred to as a second lateral face of the toner density sensor 601. Then, the harness 802 passes through the clearance 701*a* between the first side face of the toner density sensor 601 and the sensor cover 701 and is retained by the retaining groove 702 such that the harness 802 crosses the toner density sensor 601.

Figure 20:
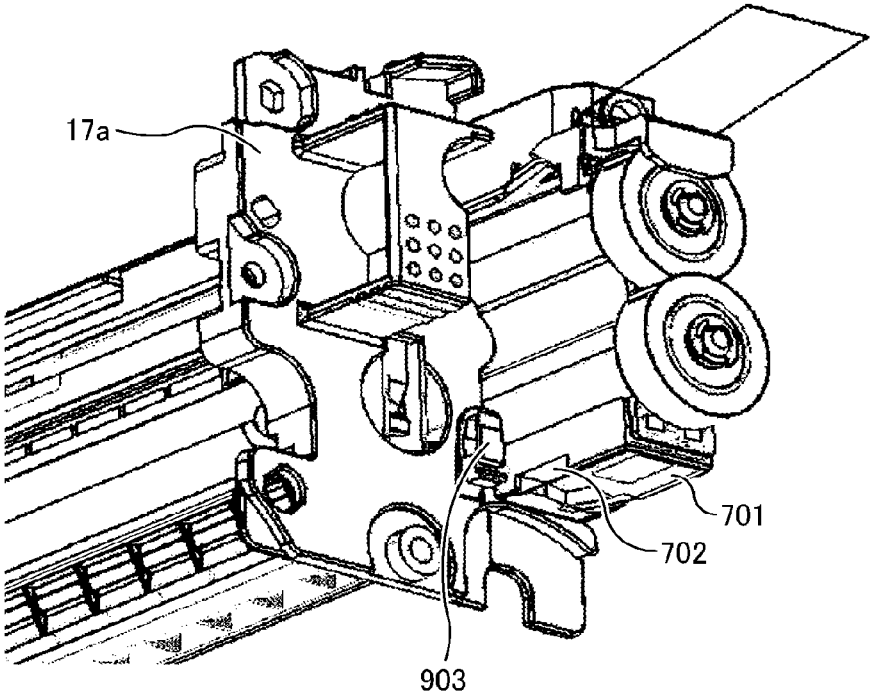
FIG. 20 is a perspective view of the front plate of the process cartridge and the developing device.
Figure 21:
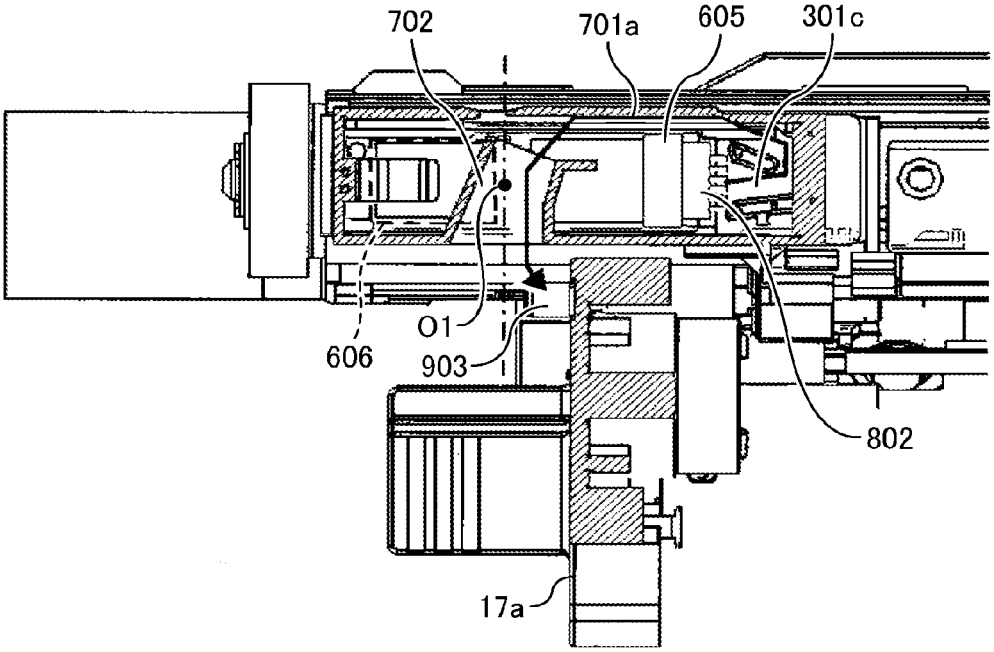
FIG. 21 illustrates relative positions of a clamp to retain the harness and the retaining groove in a longitudinal direction of the developing device.

As illustrated in FIG. 20, a harness clamp 903 is disposed on a lower part of the outer face of the front plate 17*a*. As illustrated in FIG. 21, the harness clamp 903 is on the rear side of a center O1 of the retaining groove 702 in the longitudinal direction of the process cartridge 17. In other words, the harness clamp 903 is downstream from the center O1 of the retaining groove 702 in the direction indicated by arrow Q, in which the process cartridge 17 is inserted into the apparatus. Additionally, as illustrated in FIG. 22, a lower end 904 of the harness clamp 903 (a harness securing portion) is at a height h1 from a bottom face 702*a* (a regulation face) of the retaining groove 702.

Figure 22:
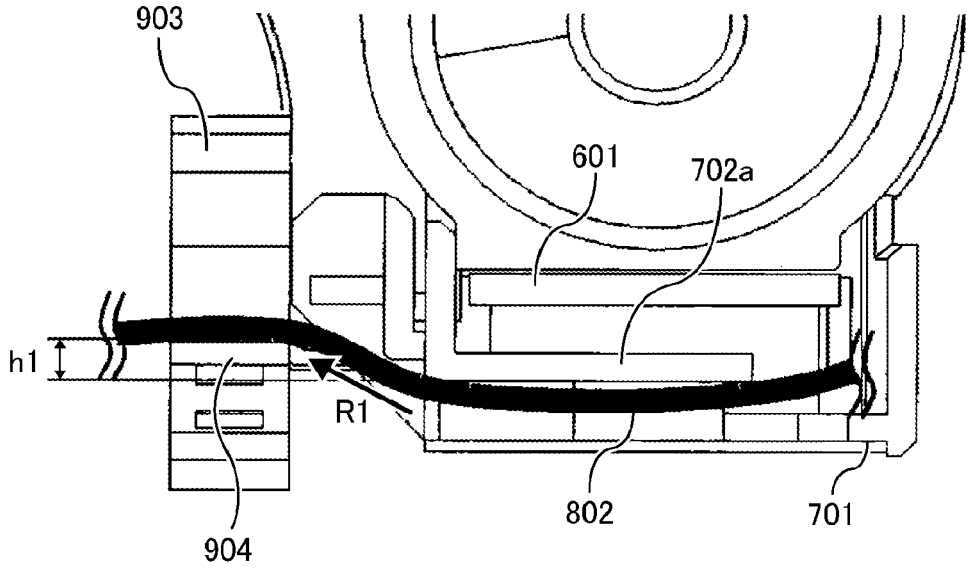
FIG. 22 illustrates the harness being pressed by the clamp to a bottom face of the retaining groove.

As illustrated in FIG. 22, as the harness 802 is secured by the harness clamp 903, the harness 802 is pulled taut in the direction indicated by arrow R1 in FIG. 22, and the crossing portion of the harness 802 crossing the toner density sensor 601 is pressed to the bottom face 702*a* of the retaining groove 702. Being pressed to the bottom face 702*a* and retained by the retaining groove 702, the crossing portion of the harness 802 is prevented from vibrating due to the vibration of the apparatus. This configuration can inhibit fluctuations in the relative positions of the crossing portion of the harness 802 crossing the toner density sensor 601 and the coil pattern 606. Accordingly, the magnetic field of the harness 802 does not disturb the magnetic field of the coil pattern 606. Consequently, the magnetic permeability of developer is detected accurately, and the density or concentration of toner is detected accurately.

As illustrated in FIG. 22, the portion of the harness 802 crossing the toner density sensor 601, retained in the retaining groove 702, is kept at a distance D from the toner density sensor 601 by the bottom face 702*a* of the retaining groove 702. In the present embodiment, the retaining groove 702 retains the portion of the harness 802 crossing the toner density sensor 601 at 2.7 mm from the toner density sensor 601. By retaining the harness 802 at a distance from the toner density sensor 601, the effect of the magnetic field of the harness 802 is suppressed, and the magnetic permeability of developer is detected accurately. Then, the percentage of toner is detected accurately.

A minimum of the distance D between the harness 802 and the toner density sensor 601 depends on the electrical current flowing to the harness 802, the conducting wire material of the harness 802, the diameter of the harness 802, the magnetic field of the coil pattern 606, and the like. Accordingly, to determine the distance D, it is preferred to study noise while changing the distance D and the current flowing to the harness 802 using the apparatus. However, in a typical apparatus specification, the effect of the magnetic field of the harness 802 is suppressed in an arrangement in which the harness 802 is retained at 0.8 mm or greater from the toner density sensor 601.

As described above, the harness clamp 903 is on the rear side of the center O1 of the retaining groove 702 as illustrated in FIG. 21. With this placement, when the harness 802 is secured by the harness clamp 903, the portion of the harness 802 crossing the toner density sensor 601 is pulled also to the back side. Consequently, the portion of the harness 802 crossing the toner density sensor 601 is pushed toward the connector 605 and retained by the retaining groove 702. Then, the portion of the harness 802 crossing the toner density sensor 601 is retained by the retaining groove 702 at a distance from the coil pattern 606, and the effect of the magnetic field of the harness 802 is better suppressed.

Further, the sensor cover 701, which includes the retaining groove 702 to hold the portion of the harness 802 crossing the toner density sensor 601, is nonmagnetic and made of plastic such as ABS resin in the present embodiment. Accordingly, the sensor cover 701 does not disturb the magnetic field of the coil pattern 606.

Figure 24:
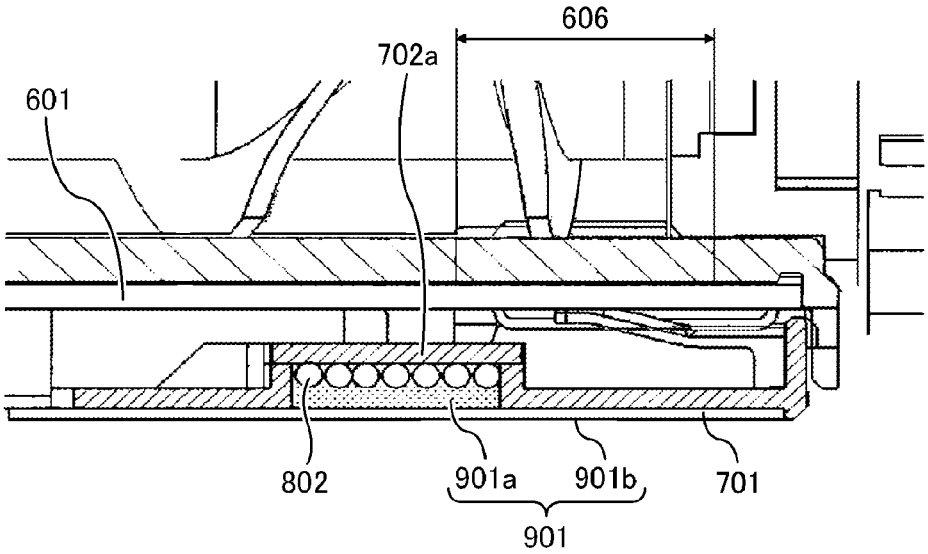
FIG. 24 is a diagram illustrating a harness pressing pad to press the harness to the bottom face of the retaining groove according to another embodiment.

Further, as illustrated in FIG. 24, in another embodiment, a harness pressing pad 901 (i.e., a harness pressing member) directly presses the portion of the harness 802 crossing the toner density sensor 601 to the bottom face 702*a* of the retaining groove 702 to retain the harness 802 in the retaining groove 702.

For example, the harness pressing pad 901 includes a film 901*b* attached to the lower face of the sensor cover 701 and an elastic body 901*a* made of sponge or the like. The height (thickness) of the elastic body 901*a* is greater than the depth of the retaining groove 702.

The film 901*b* is attached to the lower face of the sensor cover 701 via double-sided adhesive tape so that the elastic body 901*a* fits in the retaining groove 702. Then, the elastic body 901*a* is compressed and deformed to press the harness 802 retained in the retaining groove 702 against the bottom face 702*a*. With this configuration, the portion of the harness 802 crossing the toner density sensor 601 is squeezed and secured by the elastic body 901*a* and the bottom face 702*a*, thereby inhibiting the harness 802 (the portion crossing the toner density sensor 601) from vibrating. This configuration can inhibit fluctuations in the relative positions of the crossing portion of the harness 802 crossing the toner density sensor 601 and the coil pattern 606. Accordingly, the magnetic field of the harness 802 does not disturb the magnetic field of the coil pattern 606. Consequently, the magnetic permeability of developer is detected accurately, and the density or concentration of toner is detected accurately.

Although elastic body 901*a* is used in the present embodiment, alternatively, a spring can be used to press the harness 802 against the bottom face 702*a*.

Next, descriptions are given below of attachment of the sensor cover 701 to the casing 301 of the developing device 3.

Figure 25:
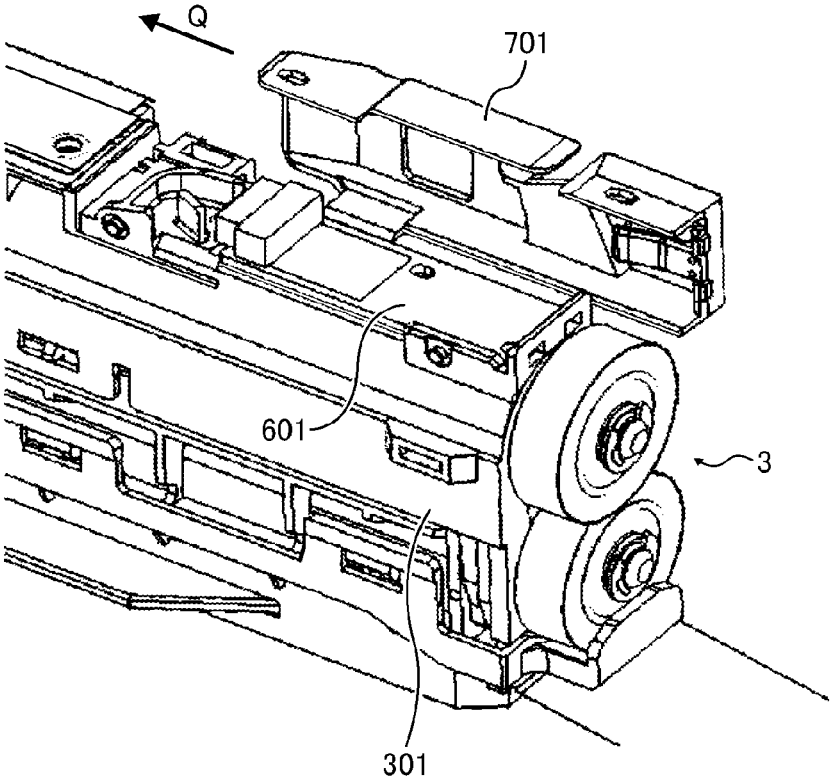
FIG. 25 is a perspective view of the developing device turned upside down, to illustrate positioning of a sensor cover on the casing of the developing device.
Figure 26:
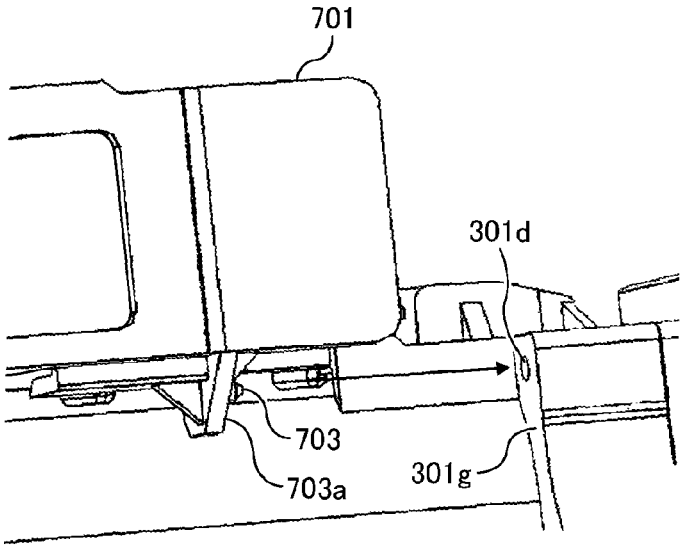
FIG. 26 illustrates a cover positioning projection and a cover positioning hole for the positioning of the sensor cover.

As illustrated in FIGS. 25 and 26, the developing device 3 is turned upside down, and the sensor cover 701 is attached to the casing 301. The sensor cover 701 is secured to the casing 301 by snap-fit, in which projections and claw-like portions are fit in engaging recesses or holes while being deformed.

As illustrated in FIG. 26, the sensor cover 701 includes a cover positioning projection 703 serving as a main positioning reference. The cover positioning projection 703 is disposed adjacent to the back end of the side face (on the side of the photoconductor 1) of the sensor cover 701. A face 703*a* on which the cover positioning projection 703 is disposed is perpendicular or almost perpendicular to the front-back direction of the developing device 3 (or the image forming apparatus 100). The cover positioning projection 703 is inserted into a cover positioning hole 301*d* in a face 301*g* of the casing 301.

As illustrated in FIG. 25, the sensor cover 701 is attached to the casing 301 as follows. Keep the sensor cover 701 in a posture illustrated in FIG. 25, which is rotated about 90 degrees from the posture of the casing 301 being attached to the casing 301 around the axis extending in the front-back direction, and move the sensor cover 701 in the direction indicated by arrow Q in FIG. 25. Then, fit the cover positioning projection 703 in the cover positioning hole 301*d* in the face 301*g* of the casing 301, and bring the face 703*a* (provided with the cover positioning projection 703 and perpendicular to the front-back direction) into contact with the face 301*g*.

Figure 27:
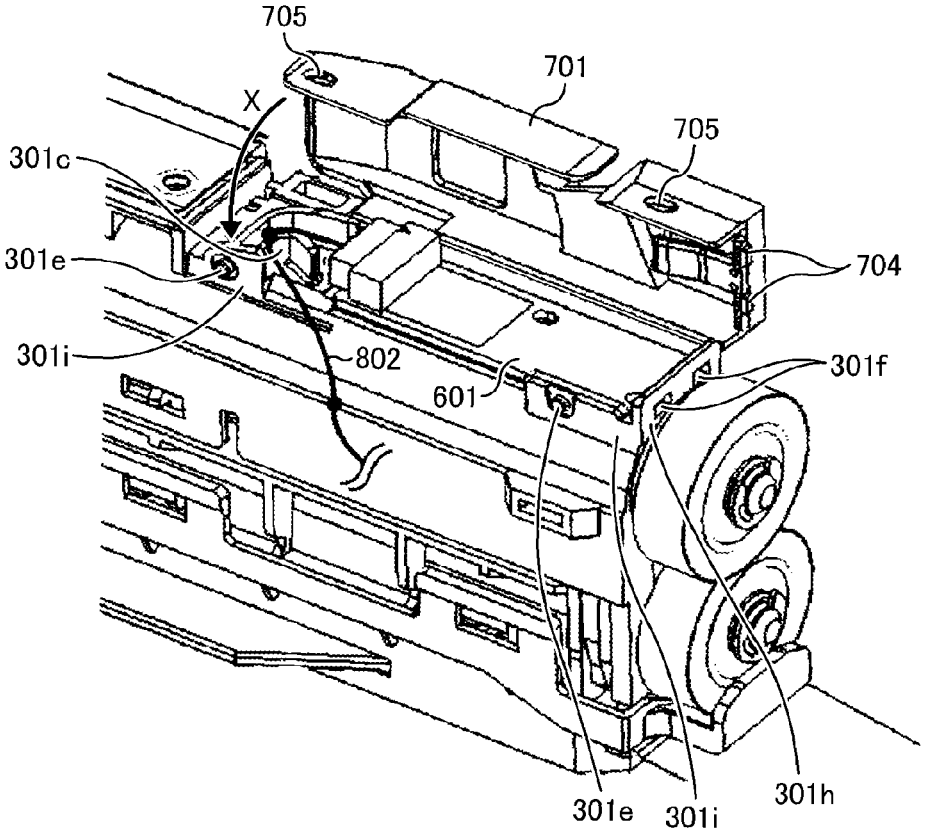
FIG. 27 is a perspective view of the developing device, to illustrate attachment of the sensor cover to the casing of the developing device.

As illustrated in FIG. 27, the front end face of the sensor cover 701 has two claws 704. Hereinafter the side face of the sensor cover 701 opposite the photoconductor 1 is referred to as a first lateral face, and the side face of the sensor cover 701 on the side of the photoconductor 1 is referred to as a second lateral face. The first lateral face (opposite the photoconductor 1) of the sensor cover 701 includes attachment holes 705. The attachment holes 705 are disposed on the front side and the back side, respectively. On the bottom face of the casing 301, a front-side mounting face 301*h* is disposed to face the front end face of the sensor cover 701. Further, side mounting faces 301*i* spaced apart are disposed on the bottom face of the casing 301. The side mounting faces 301*i* face the first lateral face of the sensor cover 701 opposite the photoconductor 1. The front-side mounting face 301*h* has two insertion holes 301*f*, in which the claws 704 on the front end face fit. A projection 301*e* projects from each side mounting face 301*i* and fits in the attachment hole 705.

After inserting the cover positioning projection 703 into the cover positioning hole 301*d*, rotate the sensor cover 701 in the direction indicated by arrow X in FIG. 27 with the cover positioning projection 703 (illustrated in FIG. 26) serving as an axis. Specifically, the sensor cover 701 is rotated while the harness 802 is pressed below to prevent the harness 802 from escaping from the guide 301*c*.

Figure 28:
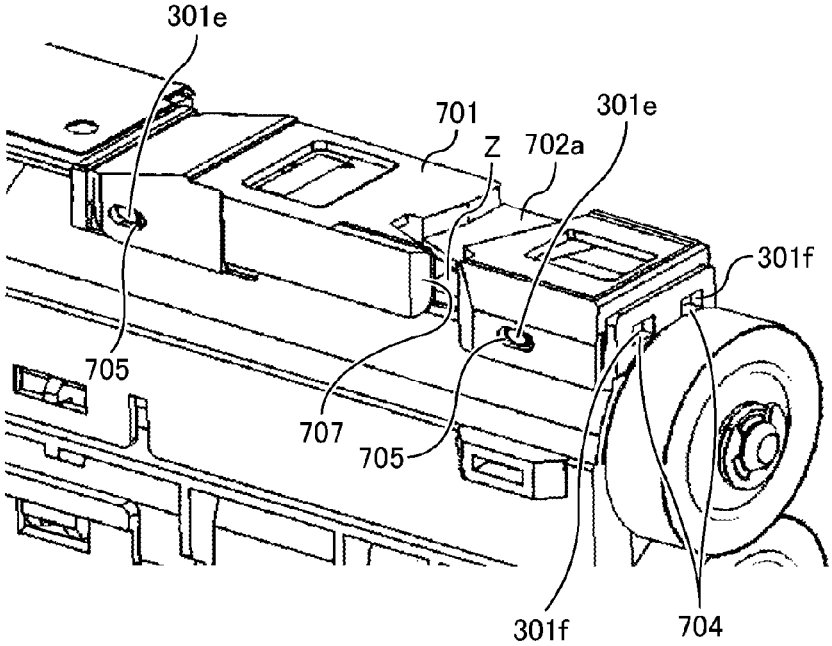
FIG. 28 is a perspective view of the sensor cover secured to the casing of the developing device.

As the sensor cover 701 rotates 90 degrees, the claws 704 on the front end face of the sensor cover 701 fit in the insertion holes 301*f* of the front-side mounting face 301*h* as illustrated in FIG. 28. Additionally, the projection 301*e* on the side mounting face 301*i* fits in the attachment hole 705. Thus, the sensor cover 701 is secured to the casing 301 by snap-fit. Snap-fit is advantageous in that the sensor cover 701 is attached to the casing 301 easily and loose fit and play of the sensor cover 701 attached to the casing 301 is inhibited with a simple structure. When loose fit and play are eliminated in the sensor cover 701 attached to the casing 301, the sensor cover 701 is inhibited from vibrating due to, for example, the vibration of the gears at the time of driving. Accordingly, the position of the harness 802, which is retained in the retaining groove 702 of the sensor cover 701, is not changed relative to the coil pattern 606 by the vibration of the sensor cover 701, and the magnetic field of the coil pattern 606 is not disturbed.

Referring to FIG. 28, the first lateral face of the sensor cover 701 opposite the photoconductor 1 is partly cut away. That is, the first lateral face of the sensor cover 701 has a cutout 707 (i.e., an opening). For the harness 802 to pass through, a clearance Z is secured between the casing 301 and the first lateral face (opposite the photoconductor 1) of the sensor cover 701 in a center portion in the front-back direction.

After attaching the sensor cover 701 to the casing 301, as illustrated in FIG. 27, insert the harness 802, which has escaped below, is inserted into the cutout 707, while inserting the harness 802 from the clearance Z into the clearance 701*a* (see FIG. 21) between the first lateral face of the toner density sensor 601 and the sensor cover 701. The harness 802 passing through the cutout 707 crosses the toner density sensor 601 and is disposed on the bottom face 702*a* of the retaining groove 702 of the sensor cover 701. Subsequently, pass the harness 802 through the harness clamp 903 (see FIGS. 20 through 22) 9 and secure the harness 802 with the harness clamp 903.

Figure 29:
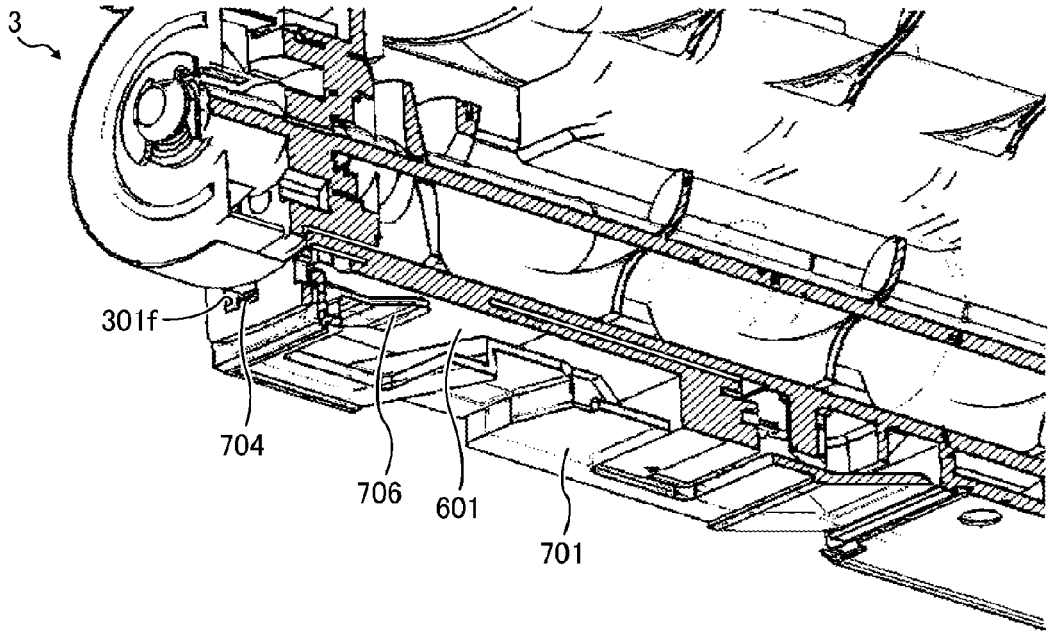
FIG. 29 is a perspective view of a flat spring of the sensor cover on the bottom face of the developing device, as viewed obliquely from below.
Figure 30:
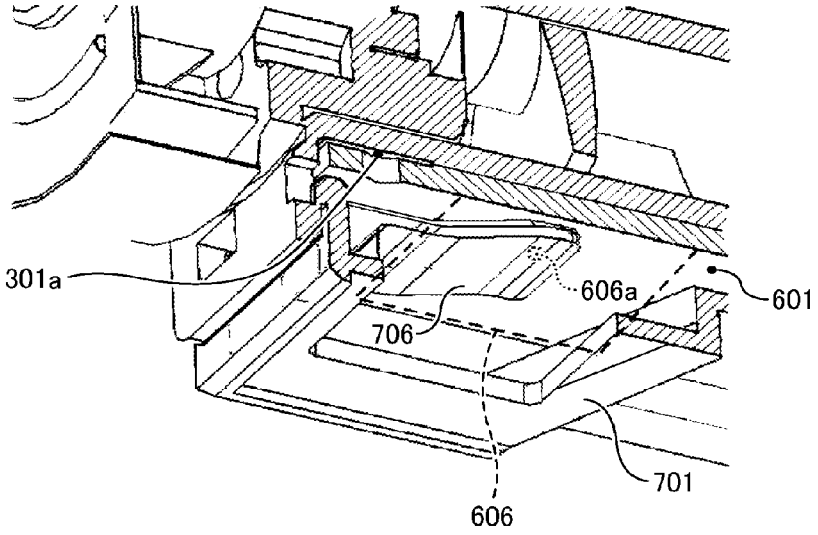
FIG. 30 is an enlarged perspective view of the flat spring in contact with the toner density sensor.

Additionally, as illustrated in FIG. 29, the sensor cover 701 includes a flat spring 706 to press the toner density sensor 601 (in particular, the portion where the coil pattern 606 is disposed) against the casing 301. As illustrated in FIG. 30, the flat spring 706 contacts or abuts the center portion (around the through hole 606*a*) of the coil pattern 606. This configuration is advantageous in preferably disposing the coil pattern 606 (on the detection face 601*a*) of the toner density sensor 601 in contact with the sensor mounting portion 301*a* of the casing 301. Consequently, the magnetic permeability of developer is detected properly, and the density or percentage of toner in developer is detected properly.

The sensor cover 701 is biased downward by the reactive force of the flat spring 706. Then, each claw 704 is pressed to the wall face defining the lower end of the insertion hole 301*f*, and the wall face defining the upper end of the attachment hole 705 is pressed to the projection 301*e*. This configuration better inhibits the sensor cover 701 from vibrating vertically. Accordingly, the position of the harness 802, which is retained in the retaining groove 702 of the sensor cover 701, is not changed relative to the coil pattern 606 by the vibration of the sensor cover 701.

The various aspects of the present specification can attain specific effects as follows.

Aspect 1

Aspect 1 concerns a developing device that includes a developer bearer (e.g., the developing roller 302) disposed to face an image bearer (e.g., the photoconductor 1) and configured to carry, by rotation, developer to a latent image on the image bearer; a developer container (e.g., the casing 301) to contain the developer; and a detector (e.g., the toner density sensor 601) to detect the developer in the developer container. The developing device further includes a wire, such as the harness 802, connected to the detector and a wire holder (e.g., the retaining groove 702, the harness clamp 903, and the like) to hold the wire and determine the position of the wire relative to the detector.

The inventors have studied the degradation in detection accuracy of toner density caused by the wire, such as the harness, disposed adjacent to the detecting portion such as the coil pattern 606 and found the followings. When the harness is disposed adjacent to the coil, a portion of the harness enters the magnetic field of the coil. As electrical current flows to the harness, the harness generates a magnetic field. If the harness vibrates due to the vibration inside the apparatus or the like, the position of the harness changes relative to the coil. Then, it is possible that the magnetic field of the harness disturbs the magnetic field of the coil, degrading the detection of magnetic permeability of developer inside the developing device.

According to Aspect 1, the wire holder maintains the position of the wire relative to the detector. This configuration can suppress the fluctuation in the relative positions of the wire and the detecting portion (e.g., the coil pattern 606) of the detector. Accordingly, disturbance of the magnetic field is suppressed, and degradation in detection accuracy is suppressed.

Aspect 2

In Aspect 1, the wire (e.g., the harness 802) is disposed such that a portion of the wire crosses (or overlaps) the detection face of the detector (e.g., the toner density sensor 601).

In this placement, it is possible that the portion of the wire (e.g., the harness) crossing the detector (e.g., the toner density sensor 601) disturbs the magnetic field of the detector, hindering the toner density detection.

In such placement, Aspect 1 is adopted to inhibit the degradation in detection accuracy.

Aspect 3

In Aspect 2, the wire holder holds the portion of the wire (e.g., the harness 802) crossing the detector (e.g., the toner density sensor 601) with the relative positions of that portion and the detector maintained.

This configuration can suppress fluctuations in the position of the portion of the wire crossing the detector (i.e., the portion of the wire disposed within the magnetic field of the detecting portion) relative to the detecting portion (e.g., the coil pattern 606). Accordingly, the degradation in detection accuracy is inhibited.

Aspect 4

In Aspect 3, the wire holder includes a contact face (e.g., the bottom face 702*a* of the retaining groove 702), which contacts the portion of the wire crossing the detector, and a harness pressing pad (901) to press the crossing portion of the wire to the contact face.

According to this aspect, as described above with reference to FIG. 24, the harness pressing pad and the contact face together squeeze and secure the portion of the wire crossing the detector. This aspect can suppress the fluctuation in the position of the portion of the wire crossing the detector and accordingly suppress fluctuations in the relative positions of that portion of the wire and the detecting portion (e.g., the coil pattern 606).

Aspect 5

In Aspect 3, the wire holder includes a contact face (e.g., the bottom face 702*a*), which contacts the portion of the wire crossing the detector, and a clamp (e.g., the harness clamp 903) to pull the crossing portion of the wire to the contact face and hold the wire in position.

According to this aspect, as described above, the portion of the wire crossing the detector is pressed to the contact face. This aspect can suppress the fluctuation in the position of the portion of the wire crossing the detector and accordingly suppress fluctuations in the relative positions of that portion of the wire and the detecting portion (e.g., the coil pattern 606).

Aspect 6

In Aspect 5, the clamp (e.g., the harness clamp 903) pulls the portion of the wire crossing the detector away from the detecting portion (e.g., the coil pattern 606) in a longitudinal direction of the developing device.

As described above with reference to FIG. 21, according to this aspect, the portion of the wire crossing the detector is retained at a distance from the detecting portion of the detector. Accordingly, the magnetic field of the detector is protected from being affected by the magnetic field of the wire. Accordingly, the degradation in detection accuracy due to the magnetic field of the wire is inhibited.

Aspect 7

In any one of Aspects 2 through 6, the wire holder holds the portion of the wire (e.g., the harness 802) crossing the detector (e.g., the toner density sensor 601) at a distance from the detector.

Figure 23:
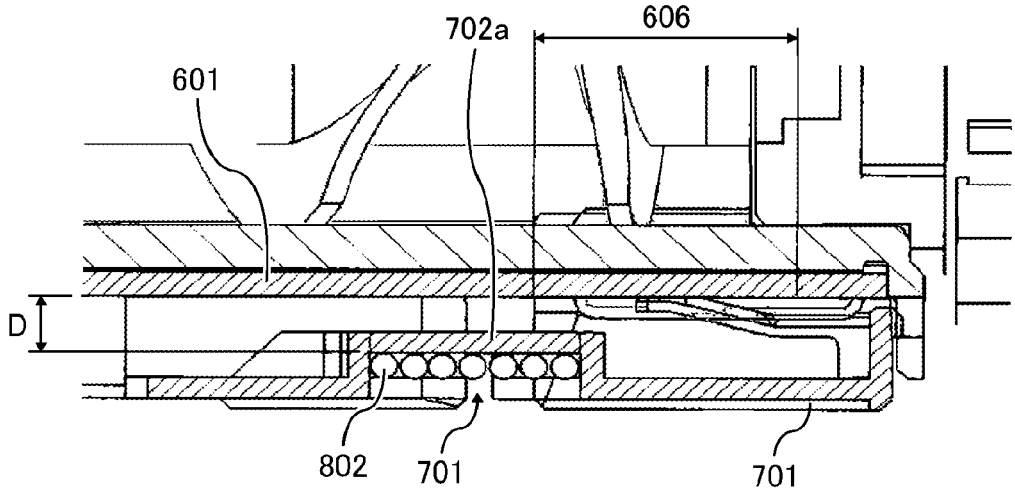
FIG. 23 is a diagram illustrating a distance between the harness retained in the retaining groove and the toner density sensor.

As described above with reference to FIG. 23, according to this aspect, the magnetic field of the wire is inhibited from affecting the magnetic field of the detecting portion (e.g., the coil pattern 606), compared with a case where the portion of the wire crossing the detector is disposed in contact with the detector. Accordingly, the degradation in detection accuracy due to the magnetic field of the wire is inhibited.

Aspect 8

In any one of Aspects 2 through 7, the wire holder is disposed in a cover (e.g., the sensor cover 701) to cover the detector (e.g., the toner density sensor 601).

In this aspect, the portion of the wire crossing the detector is held by the cover of the detector, which is advantageous in reducing the number of components and reducing the cost, compared with a case where the cover and the wire holder are separate components.

Aspect 9

In any one of Aspects 1 through 8, the detector (e.g., the toner density sensor 601) includes the detecting portion (e.g., the coil pattern 606) to detect the density of toner in the developer and a connector (e.g., the connector 605) to which the wire (e.g., the harness 802) is coupled, and the detector is secured to the outer face of the developer container (e.g., the casing 301) such that the detecting portion is disposed outside the connector in the longitudinal direction. Further, the connector is disposed inside the plate (e.g., the front plate 17*a*) to rotatably support the image bearer (e.g., the photoconductor 1) in the longitudinal direction. Further, the wire is coupled to an apparatus-side connector (101) disposed in the image forming apparatus via a space between the developing device and the image bearer.

In this arrangement, as described above, the wire (e.g., the harness 802) is disposed to cross the detector (e.g., the toner density sensor 601) to the apparatus-side connector 101. In such an arrangement, with (at least) Aspect 1, the degradation in detection accuracy due to the magnetic field of the wire is inhibited even when the wire is disposed crossing the detector.

Aspect 10

In an image forming apparatus including the image bearer (e.g., the photoconductor 1), a latent image forming device (e.g., the charger 2, the exposure device 16, and the like) to form an electrostatic latent image on the image bearer, and the developing device to develop the electrostatic latent image, the developing device according to any one of Aspects 1 through 9 is used.

According to this aspect, the percentage of toner in developer is kept constant or almost constant, thereby preferably developing the latent image. Thus, high-quality images can be produced.

Aspect 11

In a process cartridge that includes, at least, the image bearer (e.g., the photoconductor 1) and the developing device united together and is configured to be removably mounted in an image forming apparatus, the developing device according to any one of Aspects 1 through 9 is used.

According to this aspect, the percentage of toner in developer is kept constant or almost constant, thereby preferably developing the latent image on the image bearer.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer disposed opposite an image bearer, the developer bearer to rotate and carry developer to a latent image on the image bearer;

a developer container to contain the developer;

a detector including a detecting portion to detect a density of toner in the developer in the developer container;

a wire connected to the detector; and a wire holder to hold the wire and determine a position of the wire relative to the detector.

2. The developing device according to claim 1, wherein a portion of the wire is disposed crossing the detector.

3. The developing device according to claim 2, wherein the wire holder determines, relative to the detector, a position of the portion of the wire crossing the detector.

4. The developing device according to claim 3, wherein the wire holder includes:

a contact face to contact the portion of the wire crossing the detector; and a harness pressing member to press, to the contact face, the portion of the wire crossing the detector.

5. The developing device according to claim 3, wherein the wire holder includes:

a contact face to contact the portion of the wire crossing the detector; and a clamp to pull the portion of the wire crossing the detector to the contact face and secure the wire.

6. The developing device according to claim 5, wherein the clamp pulls the portion of the wire crossing the detector away from the detecting portion of the detector in a longitudinal direction of the developing device.

7. The developing device according to claim 2, wherein the wire holder holds the portion of the wire crossing the detector at a distance from the detector.

8. The developing device according to claim 2, further comprising a cover to cover the detector, wherein the wire holder is disposed in the cover.

9. The developing device according to claim 1, wherein the detector includes a connector to which the wire is coupled, wherein the detector is secured to an outer face of the developer container with the detecting portion disposed outside the connector in a longitudinal direction of the developing device, wherein, in the longitudinal direction of the developing device, the connector is disposed inside a plate to rotatably support the image bearer, and wherein the wire is disposed between the developing device and the image bearer and coupled to an apparatus-side connector disposed in an image forming apparatus.

10. An image forming apparatus comprising:

the image bearer;

a latent image forming device to form an electrostatic latent image on the image bearer; and the developing device according to claim 1 to develop the electrostatic latent image.

11. A process cartridge to be removably mounted in an image forming apparatus, the process cartridge comprising:

the image bearer to bear an electrostatic latent image;

the developing device according to claim 1 to develop the electrostatic latent image; and a common support to support the developing device together with the image bearer.

* * * * *